US010066409B2

(12) United States Patent
Sansom, III et al.

(10) Patent No.: US 10,066,409 B2
(45) Date of Patent: Sep. 4, 2018

(54) ACCESSIBLE PORTABLE RESTROOM AND FLOOR SYSTEM AND STRUCTURES FOR PORTABLE RESTROOMS AND SIMILAR ENCLOSURES

(71) Applicants: Clyde Sansom, III, St. Louis, MO (US); Henry Brown, Portage, WI (US)

(72) Inventors: Clyde Sansom, III, St. Louis, MO (US); Henry Brown, Portage, WI (US)

(73) Assignee: Sansom Industries LLC, St. Louis, MO (US)

( * ) Notice: Subject to any disclaimer, the term of this patent is extended or adjusted under 35 U.S.C. 154(b) by 0 days.

(21) Appl. No.: 15/715,438

(22) Filed: Sep. 26, 2017

(65) Prior Publication Data

US 2018/0016805 A1 Jan. 18, 2018

Related U.S. Application Data

(63) Continuation-in-part of application No. 15/646,830, filed on Jul. 11, 2017.

(Continued)

(51) Int. Cl.

| | |
|---|---|
| ***E04H 1/12*** | (2006.01) |
| ***E04B 1/348*** | (2006.01) |
| *E04F 15/024* | (2006.01) |

(52) U.S. Cl.

CPC ..... *E04H 1/1216* (2013.01); *E04B 1/34869* (2013.01); *E04H 1/1266* (2013.01); *E04F 15/0247* (2013.01)

(58) Field of Classification Search

CPC ..... E04H 1/1216; E04H 1/1266; E03D 7/00; E04B 1/34869; E04F 15/0247; E04F 15/02494

See application file for complete search history.

(56) References Cited

U.S. PATENT DOCUMENTS 2,238,513 A 4/1941 Ward et al.
3,601,821 A 8/1971 Corsiglia (Continued)

FOREIGN PATENT DOCUMENTS

BR 202012029494-5 U2 9/2014

OTHER PUBLICATIONS

International Search Report and Written Opinion of the International Searching Authority dated Mar. 31, 2017 for International Appln. No. PCT/US2016/057217 filed Oct. 14, 2016, 18 pages.

(Continued)

*Primary Examiner* — Andrew J Triggs

(74) *Attorney, Agent, or Firm* — Boardman & Clark LLP

(57) ABSTRACT

An accessible or ADA/ANSI compliant style of portable restroom is provided. The portable restroom includes one or more of the features of: structural supports and/or curved sidewall segments allowing for the use of lighter weight material or construction of thinner walls and roof; improved holding tank structure; improved joints; vertical and horizontal grab bars; grab bar mounts which are molded into the restroom sidewall and facilitate mounting high impact yet flexible tubing; an improved lightweight floor structure, and a floor having upturned flanges which provide an area for attachment of the sidewalls; and integrated recesses in the floor for lift truck forks, among other features. A floor structure is also provided that comprises a sheet of material forming a floor, the material having an upturned flange surrounding its perimeter, and a threshold formed by a recess in the upturned flange on the perimeter of the plastic sheet. One or more self-leveling devices are provided for leveling the threshold and/or the floor.

19 Claims, 28 Drawing Sheets

Related U.S. Application Data

(60) Provisional application No. 62/360,673, filed on Jul. 11, 2016, provisional application No. 62/446,062, filed on Jan. 13, 2017.

(56) References Cited

U.S. PATENT DOCUMENTS 4,238,858 A * 12/1980 Maihart ..... E04B 31/34869 4/546
4,574,025 A 3/1986 Juaire et al.
4,670,918 A 6/1987 Juaire et al.
4,736,555 A * 4/1988 Nagare ..... E04F 15/02452 248/544
4,769,863 A 9/1988 Tegg et al.
4,775,109 A 10/1988 Tegg et al.
D300,351 S 3/1989 Juaire et al.
4,991,256 A 2/1991 Jeynes et al.
D315,196 S 3/1991 Tegg et al.
D337,831 S 7/1993 McNamara et al.
D338,967 S 8/1993 Tegg
D341,193 S 11/1993 Hart
D351,222 S 10/1994 Zenner
D354,142 S 1/1995 McNamara et al.
D356,851 S 3/1995 Holmstadt et al.
D357,543 S 4/1995 Holmstadt et al.
D372,537 S 8/1996 Loebertmann
5,603,184 A 2/1997 Campbell et al.
5,682,622 A * 11/1997 Tagg ..... E04H 1/1216 4/449
6,052,838 A 4/2000 Thom et al.
D444,570 S 7/2001 Eliasen et al.
D447,814 S 9/2001 Swagel et al.
6,289,557 B1 9/2001 Manson et al.
6,327,719 B1 12/2001 Lobertmann et al.
6,349,426 B1 * 2/2002 Wieringa ..... A47K 11/02 4/449
6,438,902 B1 * 8/2002 Muller ..... E04H 1/1216 4/460
6,796,087 B1 9/2004 Greene
D578,656 S 10/2008 Holmstadt et al.
7,975,325 B2 7/2011 Holmstadt et al.
8,091,157 B2 * 1/2012 Tyler ..... E04H 1/1216 4/477
2004/0101357 A1 * 5/2004 Dijkstra ..... B65D 7/24 403/403
2004/0163335 A1 8/2004 Hampel et al.
2008/0209624 A1 * 9/2008 Lavoie ..... E04H 1/1216 4/449
2017/0051486 A1 2/2017 Schomburg et al.

OTHER PUBLICATIONS

International Search Report and Written Opinion of the International Searching Authority dated Dec. 14, 2017 for International Appln. No. PCT/US2017/041536 filed Jul. 11, 2017, 9 pages.

* cited by examiner

ACCESSIBLE PORTABLE RESTROOM AND FLOOR SYSTEM AND STRUCTURES FOR PORTABLE RESTROOMS AND SIMILAR ENCLOSURES

CROSS-REFERENCE TO RELATED APPLICATIONS

This application is a Continuation-in-Part of U.S. patent application, Ser. No. 15/646,830, filed Jul. 11, 2017, entitled ACCESSIBLE PORTABLE RESTROOM & FLOOR SYSTEM AND STRUCTURES FOR PORTABLE RESTROOMS & SIMILAR ENCLOSURES, which claims priority to U.S. Provisional Patent Application, Ser. No. 62/360,673, filed Jul. 11, 2016, entitled FLOOR SYSTEM AND STRUCTURE FOR PORTABLE RESTROOM AND SIMILAR ENCLOSURES; and claims priority to U.S. Provisional Patent Application, Ser. No. 62/446,062, filed Jan. 13, 2017, entitled FLOOR SYSTEM AND STRUCTURES FOR PORTABLE RESTROOMS & SIMILAR ENCLOSURES, the entire contents of each of which is hereby incorporated herein by reference.

FIELD

The present inventions relate to the field of portable restrooms. The present inventions more specifically relate to the field of floor systems and structures for portable restrooms and similar enclosures, such structures being designed for accommodation of individuals with disabilities and others.

BACKGROUND

A portable restroom offers features that provide users temporary toilet functions in a physically and emotionally secure environment which is designed with the goal of offering the owner/operator a cost-effective means of providing the service.

Portable restrooms are generally composed of a portable enclosure containing a chemical toilet, and are typically used as a temporary toilet for construction sites, large gatherings, or as a cost-saving alternative to maintaining larger plumbing infrastructure, among other temporary needs. They are generally constructed out of a lightweight molded plastic. Portable restrooms are typically large enough for only a single occupant. Some include both a seated toilet and urinal. Most include lockable doors and a means to vent the holding tank.

As indicated, portable restrooms are often designed for use by a single occupant. Unfortunately, many portable restrooms offer limited interior space. Accordingly, some restrooms are designed to accommodate wheelchair users and others seeking easier access and more room than conventional portable restrooms offer; such as adults with small children, the elderly, and/or more often than not, capable adults seeking more comfort than offered by conventional portable restrooms. In the United States, the Americans with Disabilities Act ("ADA") regulatory requirements and American National Standards Institute (ANSI A117.1) often guide the design and manufacture of these restrooms (e.g., ADA compliant, or wheelchair accessible restrooms or "comfort stations"). This type of restroom is often as much as four times larger than the common portable restroom, adding significant handling challenges (and corresponding costs) in transportation and placement due to the significant increase in bulk and weight. In addition to the increased cost of handling and transportation, such portable restrooms are also typically more expensive to produce and maintain.

This ADA compliant type of portable restroom may include a grab bar which may be used by the user (e.g., "grabbed") to assist in moving about the interior of the restroom. It is common industry practice to fabricate a restroom grab bar from metal or plastic with integral mounting features. These mounting features are in turn mounted to the walls of the portable restroom.

Currently, this larger ADA compliant type of portable restroom has a floor made of a solid sheet of plastic that rests upon the ground. Fasteners attach the portable restroom sidewall(s) to the base. More specifically, the floor in such portable restrooms is connected to the sidewalls by means of an attachment bracket or component providing two mounting surfaces spaced or positioned from one another at approximately 90 degrees. The attachment bracket is a separate part which requires fastening to both the sidewall and the floor. As seen in FIG. 1, the attachment bracket C joins the walls or other vertical components to the floor with mechanical fasteners.

As the term "portable restroom" implies, the portable restroom must be movable or transportable. The bulk and weight of this ADA compliant style of restroom often necessitates handling it with an industrial forklift truck. As seen in FIG. 1, the floor thickness A typically is less than the under-taper B of the lifting forks on the fork lift truck, inviting the lifting fork to damage the attachment bracket and corresponding fasteners joining the wall to the floor. Additionally, the heads of the fasteners holding the attachment bracket to the floor are prone to wear-off due to abrasion caused by sliding the portable restroom, and consequently fastener head, on hard surfaces.

Therefore, a need exists in the art for an improved portable restroom which provides one or more solutions to the above-described drawbacks.

SUMMARY

Accordingly, an improved portable restroom is provided which may be an accessible or ADA/ANSI compliant style of portable restroom. The portable restroom offers features providing users with temporary toilet functions in a physically and emotionally secure environment while offering the owner/operator a cost-effective and durable means of providing service. The portable restroom accomplishing the foregoing objectives includes, among other features, one or more of the features of: structural supports and/or curved sidewall segments allowing for the use of lighter weight material or construction of thinner walls and roof; improved holding tank structure; improved joints; vertical and horizontal grab bars; grab bar mounts which are molded into the restroom sidewall and facilitate mounting high impact yet flexible tubing; an improved floor structure formed of an at least partially hollow core, a single sheet floor, and a floor having upturned flanges which provide an area for attachment of the sidewalls; and integrated recesses in the floor for lift truck forks, among other features.

A floor structure for a portable restroom is also disclosed. The floor structure includes one or more sheets of material. The material has an upturned flange surrounding its perimeter. The upturned flange has one or more notched corners and a door opening formed by a recess in the perimeter of the plastic sheet. A protrusion is also provided on the interior of the flange, which protrusion may form a portion of a cradle or nest for a holding tank.

A portable restroom assembly is also provided. The assembly includes a floor having a cradle or nest for a holding tank, the nest arranged to locate and support the holding tank thereon and a tank having a lower sidewall or more than one such lower sidewall matingly shaped to engage the cradle or nest in the floor in order to nest the tank in position in the portable restroom.

An occupant support system for a portable restroom is also disclosed. The system includes a horizontal grab bar and a vertical grab bar. The horizontal and vertical grab bars are located near a toilet. The vertical grab bar is mounted to the floor and ceiling of the portable restroom, and extends the entire length therebetween. The vertical grab bar is secured by molded-in pockets provided in the floor and the roof of the portable restroom. Grab bar mounts or supports are molded as integral components of a restroom sidewall and extend inward into the interior of the portable restroom. The horizontal grab bar is mounted to the grab bar mounts.

A portable restroom having a floor structure is also disclosed. The floor structure comprises a sheet of material forming a floor, the material having an upturned flange surrounding its perimeter. A threshold is formed by a recess in the upturned flange on the perimeter of the material sheet. One or more self-leveling devices are provided for leveling the threshold and/or the floor.

In addition, a floor structure for a portable restroom is disclosed which includes a sheet of material forming a floor, the material having an upturned flange surrounding its perimeter. A threshold is formed by a recess in the upturned flange on the perimeter of the material sheet. Self-leveling devices for leveling the threshold and/or the floor are provided. The self-leveling devices comprise a first slit and through hole on a first side of the threshold and a second slit and through hole on a second side of the threshold, which slits isolate the threshold from compressive stresses and allow the threshold to self-level and lie flat.

An additional floor structure for a portable restroom is disclosed. The floor structure includes a sheet of material forming a floor, the material having an upturned flange surrounding its perimeter. A threshold is formed by a recess in the upturned flange on the perimeter of the material sheet. A self-leveling device for leveling the threshold and/or the floor is provided, wherein the self-leveling device comprises a jamb leveler provided in the floor.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein:

(FIG. 10B illustrates a floor with notched corners).

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

The portable restroom having the features described herein has various advantages, including but not limited to, reduced weight, and a reduction in the maintenance costs and handling problems associated with current portable restrooms designed toward ADA/ANSI compliance.

Figure 2:
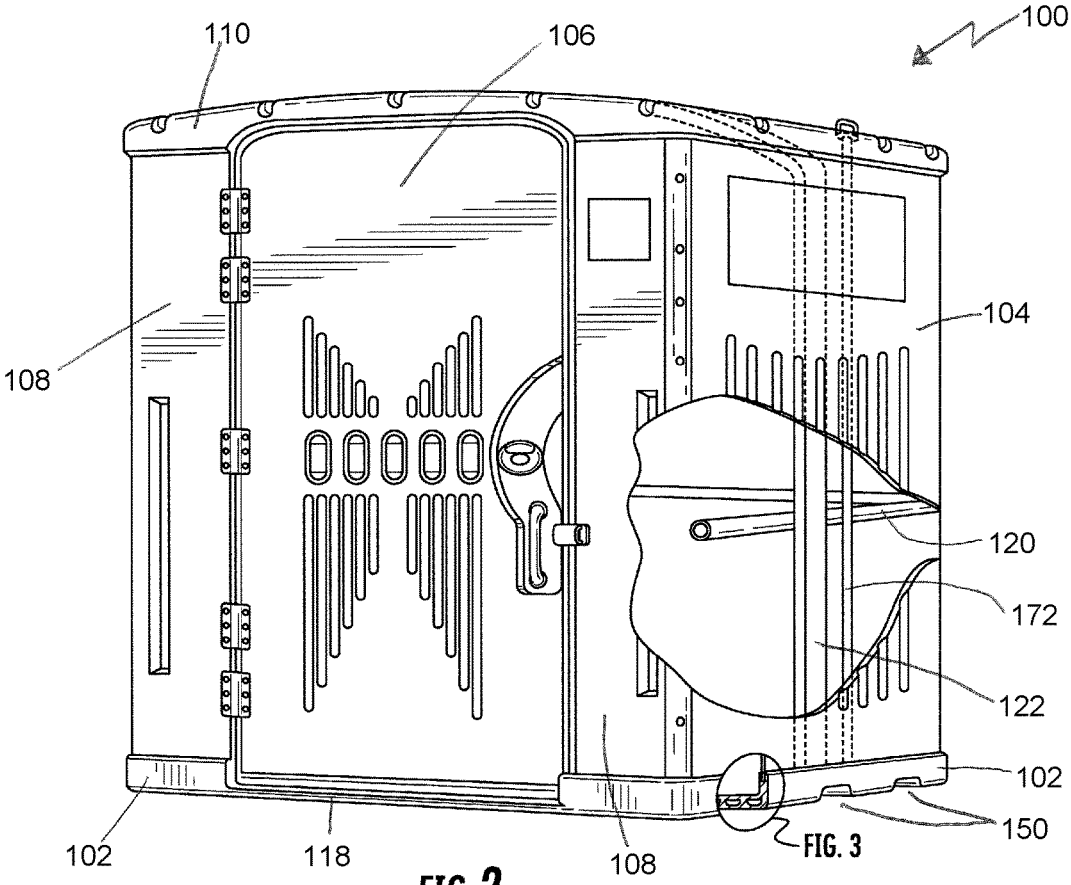
FIG. 2 illustrates a portable restroom according to one or more examples of embodiments described herein, including a cut-away to reveal one or more components.

Referring generally to the Figures, an improved portable restroom or "accessible" portable restroom 100 is provided. One or more examples of an accessible portable restroom 100 as described herein are shown in FIG. 2. The portable restroom 100 generally includes a base or floor structure 102, a plurality of sidewalls 104 (e.g., at least three walls or sidewalls), a door 106, one or more door jambs or frame 108, a roof 110, a vent (not shown), and a toilet 112 with a holding tank 114 (see, e.g., FIGS. 5-7). The portable restroom 100 offers features providing users with temporary toilet functions in a physically and emotionally secure environment while offering the owner/operator a cost-effective and durable means of providing service.

As may be viewed from the restroom 100 shown in FIG. 2, the portable restroom 100 disclosed herein is generally wider than a typical restroom, including a wider door 106, and a low or minimal edge along the floor 102 at the base of the door frame 118, providing a low step, or no step up into the portable restroom 100. In addition, other features typically available for disabled users may be provided within the portable restroom 100, such as for example, an arm rail or grab bar 120 attached to the sidewall(s) 104 and/or rear wall 104*a* (one or more examples of which are discussed in further detail below). A "hands-free" system for access to and use of the portable restroom 100 may also be provided. Suitable examples are shown in United States Patent Publication No. 20170107730, which is hereby incorporated by reference herein in its entirety. Likewise, one or more additional features providing an enhanced or improved user experience, as well as those features common to a portable restroom 100, may also be provided. Various examples of such features are disclosed in United States Patent Publication No. 20170107730.

The portable restroom assembly 100 is generally constructed of polyethylene or other durable plastic. According to one or more examples of embodiments, the weight of the restroom may be reduced while improving its durability through strategic integration of metal and/or composite structural components in the roof 110 and/or sidewalls 104, allowing for reduced thickness and/or weight sidewalls 104 and roof 110. More specifically, one or more internal structural components may be provided which stiffen the sidewalls 104, as well as to support the roof 110 (and, optionally, hand rails). An example of such a structural support 122 is shown in FIG. 2. The structural support 122 may extend from the base 102, vertically up the sidewall(s) 104, and may extend across the roof 110—or portions thereof. In the illustrated embodiment, the structural support 122 is approximately centered on the sidewall 104 and roof 110, although variations thereon may be acceptable. It is contemplated that such structure may be provided within the formed sidewalls 104 and/or roof 110, or attached on a surface thereof whether within the interior or on the exterior of the portable restroom sidewall 104 or roof 110. The structural support 122 in the illustrated embodiment has a width which is narrower than the sidewall 104 or roof 110, but sufficient to at least partially provide structural support and rigidity to the sidewall 104 or roof 110 such that lighter weight material or thinner material may be used for the sidewall and/or roof. It is also contemplated that the structural support 122 may extend the width of the sidewall 104. Preferably, the structural support 122 is formed of a durable rigid material suitable for supporting the weight of the respective wall, the hand rail (which may be attached to the structural support 122), and an individual who may use the hand rail or grab bar 120 for support. A plurality of structural supports 122 may also be provided, spaced apart along the width of the sidewall 104 or roof 110. It is also contemplated that one or more structural supports 122 may be positioned horizontally or diagonally along or across the sidewall 104 or roof 110 to provide the advantageous features described herein.

The base or floor structure 102 is also formed in a manner which maintains structural strength and rigidity while reducing overall weight. In one example, the floor structure or floor 102 may be formed out of two formed sheets 124, 126 (which may be of plastic material) strategically welded or otherwise attached together to form a semi-hollow part or hollow core, thus reducing the weight (see, e.g., FIGS. 3-5). The weight of the floor system 102 can also be reduced by, for example, molding it with a plastic upper sheet and lower sheet 124, 126 with a lighter weight core 128 material, such as a foam core (see, e.g., FIG. 4). Alternatively, the floor 102 may be formed of a thin, but solid sheet of material, using suitable processing methods, examples of which include straight line forming or other processes, such as compression molding or injection molding (see FIGS. 9-10). In one or more examples of embodiments, the floor 102 has an upturned flange 130 surrounding at least a portion of its perimeter.

Figure 9:
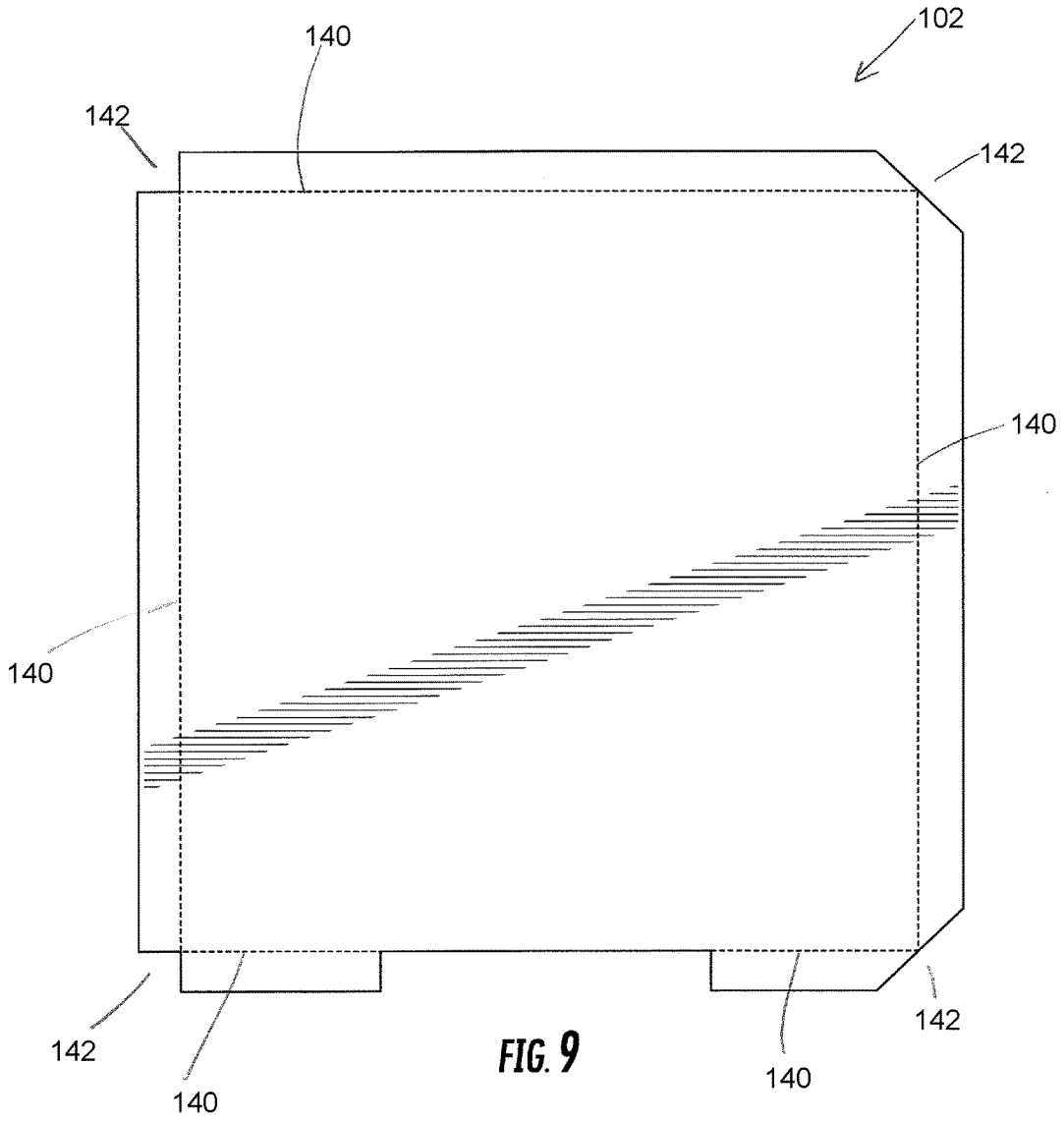
FIG. 9 illustrates a flat plastic sheet cut to form a floor of a portable restroom and having one or more bend lines.

One example of straight line forming of a portable restroom floor 102 is shown in FIG. 9. In one or more examples of embodiments, a planar plastic sheet (e.g., a single planar plastic sheet) is formed, cut, shaped, molded, etc., by suitable means. Straight line forming of the plastic sheet may include use of radiant wires which focus heat along a straight line to weaken the plastic sheet sufficiently to bend it along said line. As can be seen in FIG. 9, straight line forming may be provided at "bend lines" 140 in predetermined or strategic locations about the plastic sheet. After the sheet is heated and bent it is held in position until cool. Straight line bending offers significant advantages over other plastic molding processes because the entire mass does not need to be heated; in addition, it potentially has less post-mold warping. In one or more examples of embodiments, straight line forming may be used to create means of joining sidewalls 104 to the floor or floor structure 102, for example, by forming an upturned flange 130 on the perimeter of the floor or floor structure 102. While straight line forming is provided as one example of forming the floor structure 102 described herein, various alternative methods of forming may also be acceptable to form floor structures having the advantages described herein.

In addition to a reduced weight, formed floor structure 102, the corners of the floor structure 102 may also be provided with various advantageous features. In the illustrated example, one or more notched corners 142, such as square notched corners as well as and/or one or more angle notched corners, may also be provided along or about the perimeter of the floor or floor structure 102. In one example, the plastic sheet forming the floor structure is provided with said notched corners 142 spaced around the sheet. In addition, a door opening 118 may also be provided in the floor or floor structure 102. The door opening 118 may be formed by a cut out or recess in the perimeter of the plastic sheet forming the floor structure 102.

Figure 10A:
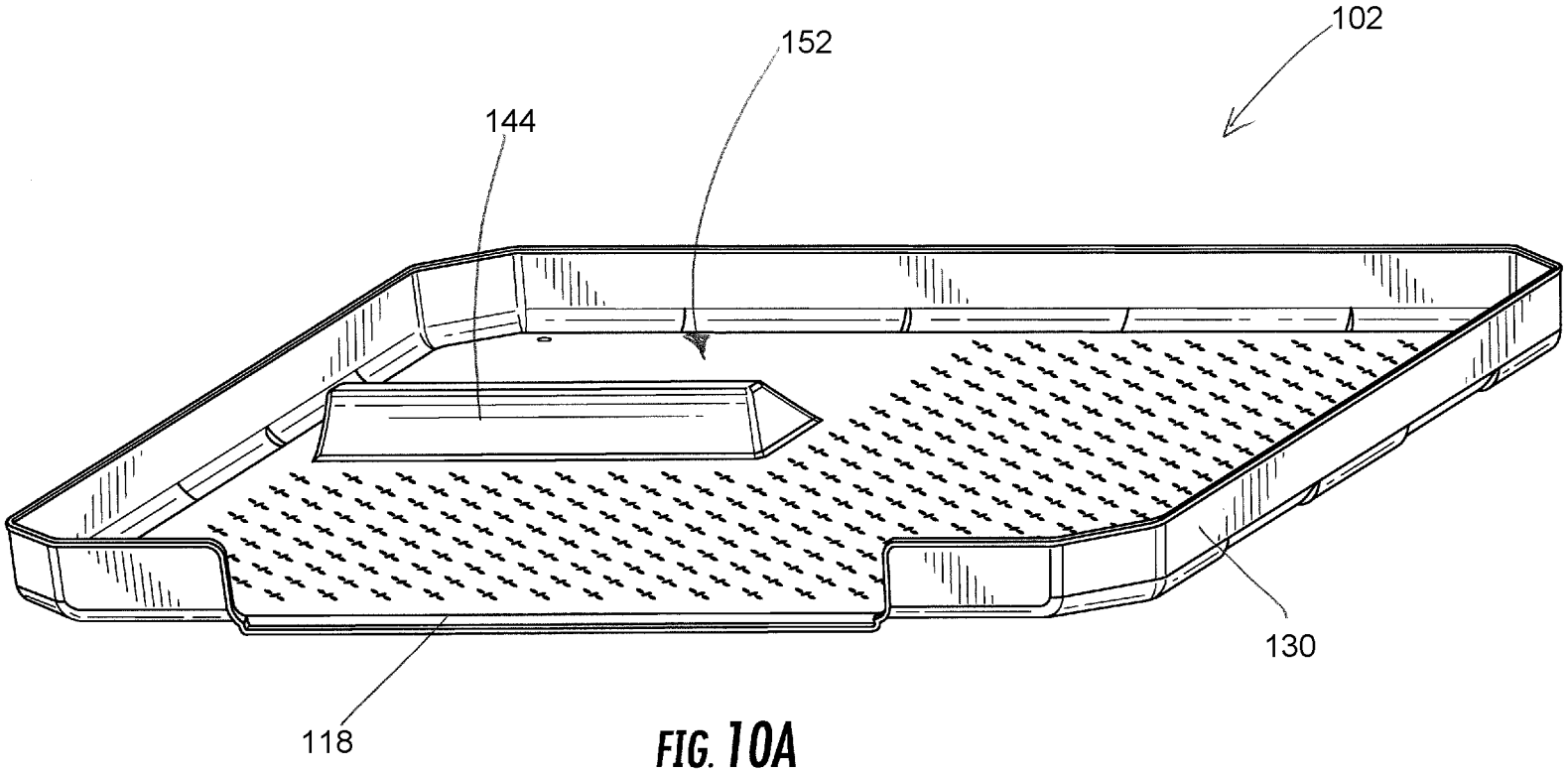
FIG. 10A-B illustrate a floor for use with the portable restroom described herein having upturned flanges, formed by bending the plastic sheet along the bend lines, such as set forth in FIG. 9, and a block for supporting the holding tank
Figure 10B:
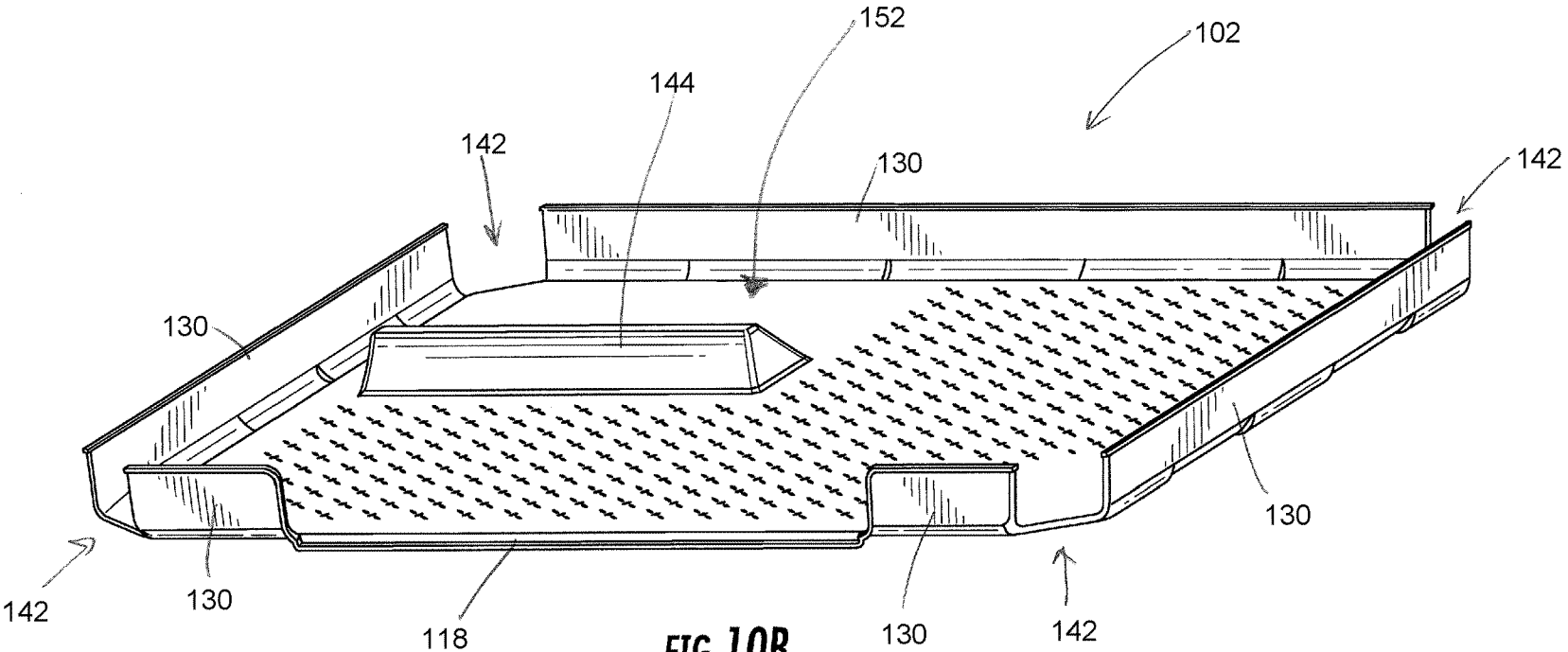

An example of a floor 102 or plastic sheet such as shown in FIG. 9, having bends which form upward turned flanges 130 (or upwardly extending flanges) at predetermined or strategic locations is shown in FIG. 10A-B. As can be seen, the result is a restroom floor 102 without corners (which may advantageously reduce or eliminate warping of the floor bottom). As can be seen in FIG. 10A-B, multiple flanges 130 are present as well as an area without a flange which forms a door opening 118 (and access for, for example, a wheelchair). In addition, as shown in in FIG. 10A-B, the floor 102 may be provided with a protrusion 144 interior of the flanges 130 which protrusion may form a portion of a cradle or nest 152 for a holding tank 114.

Figure 1:
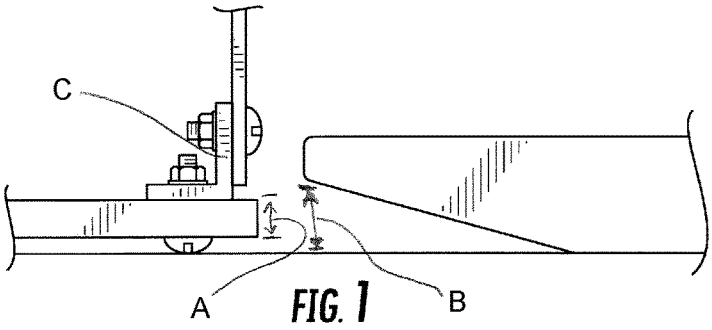
FIG. 1 (PRIOR ART)
FIG. 1 illustrates a cut-away side elevation view of a prior art portable restroom floor, attachment bracket and sidewall, and the relationship of same to a lift truck fork used to move the portable restroom.

In addition to the structural support and features provided for reduction in weight described above, the floor 102 of the portable restroom 100 also includes additional features that enhance the floor over existing structures. In one example of embodiments, the floor 102 eliminates the relatively fragile 90 degree joining component or attachment bracket C and its fasteners described herein and shown in FIG. 1 for attachment of the sidewalls. More specifically, as described herein a portion of the horizontal floor material is formed with an upwardly extending flange 130 along its outer edge (as previously described). The flange 130 may extend upward at an approximate 90 degree angle relative to the floor 102 and has a joining area for the sidewall 104 positioned a suitable distance above the entry elevation of a lift truck's fork. While a 90 degree angle is specifically described, it is understood that the invention is not limited thereto and other angles may be suitable for the purposes provided. As can been in FIG. 3, which shows a section view of FIG. 2, the floor 102 includes an integral flange 130 extending at an angle relative to the floor 102 and formed of the same material as the floor 102. As indicated, preferably, the flange 130 extends perpendicular to the floor 102 or at an approximate 90 degree angle.

Figure 11:
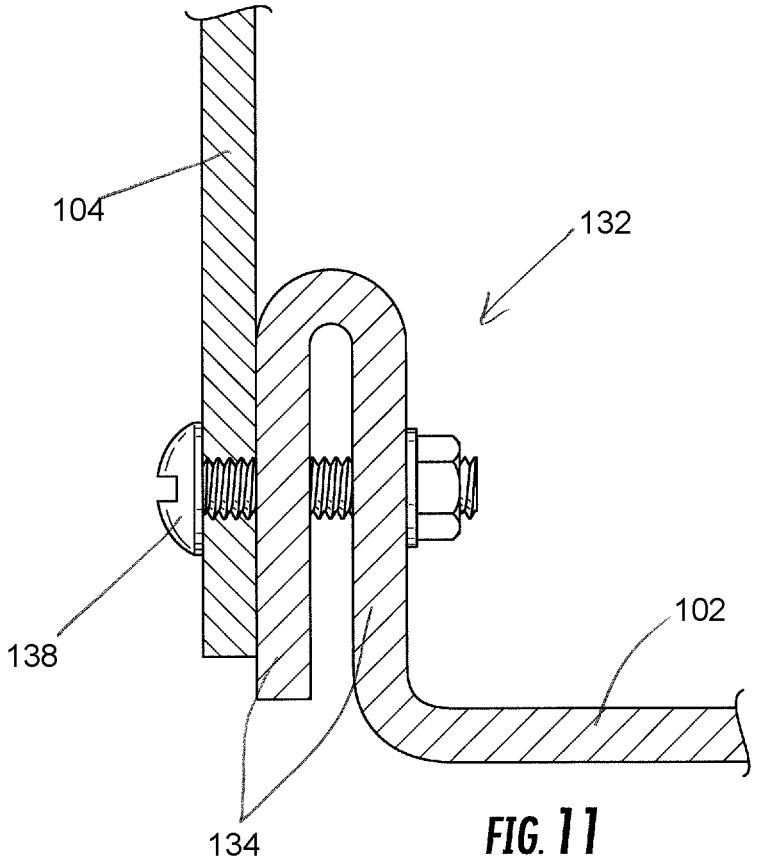
FIG. 11 illustrates an upturned flange or wall mounting flange for use with the portable restroom as described herein, showing a double bend wall flange formed with the floor.
Figure 12:
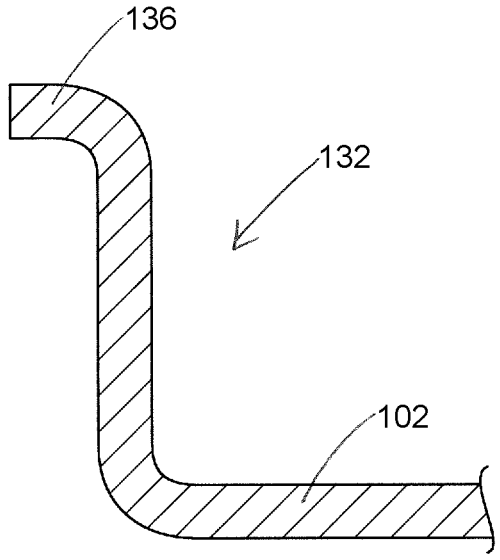
FIG. 12 illustrates an upturned flange or wall mounting flange for use with the portable restroom as described herein, showing a single bend wall flange formed with the floor and having a stiffening rib.
Figure 13:
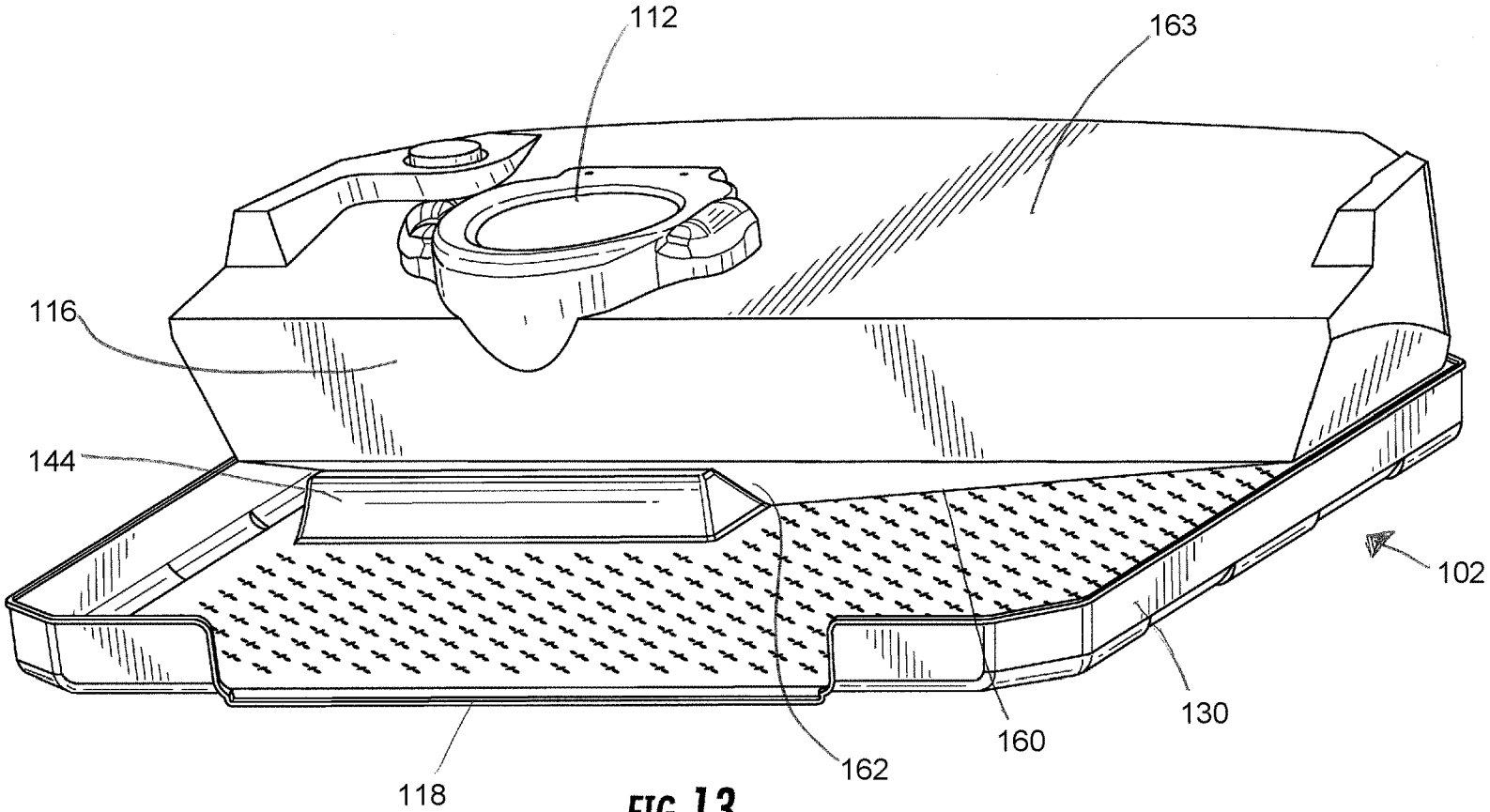
FIG. 13 illustrates a perspective view of a holding tank and floor assembly for a portable restroom as described herein, showing a large holding tank supported by a retention block or protrusion in the floor.
Figure 14:
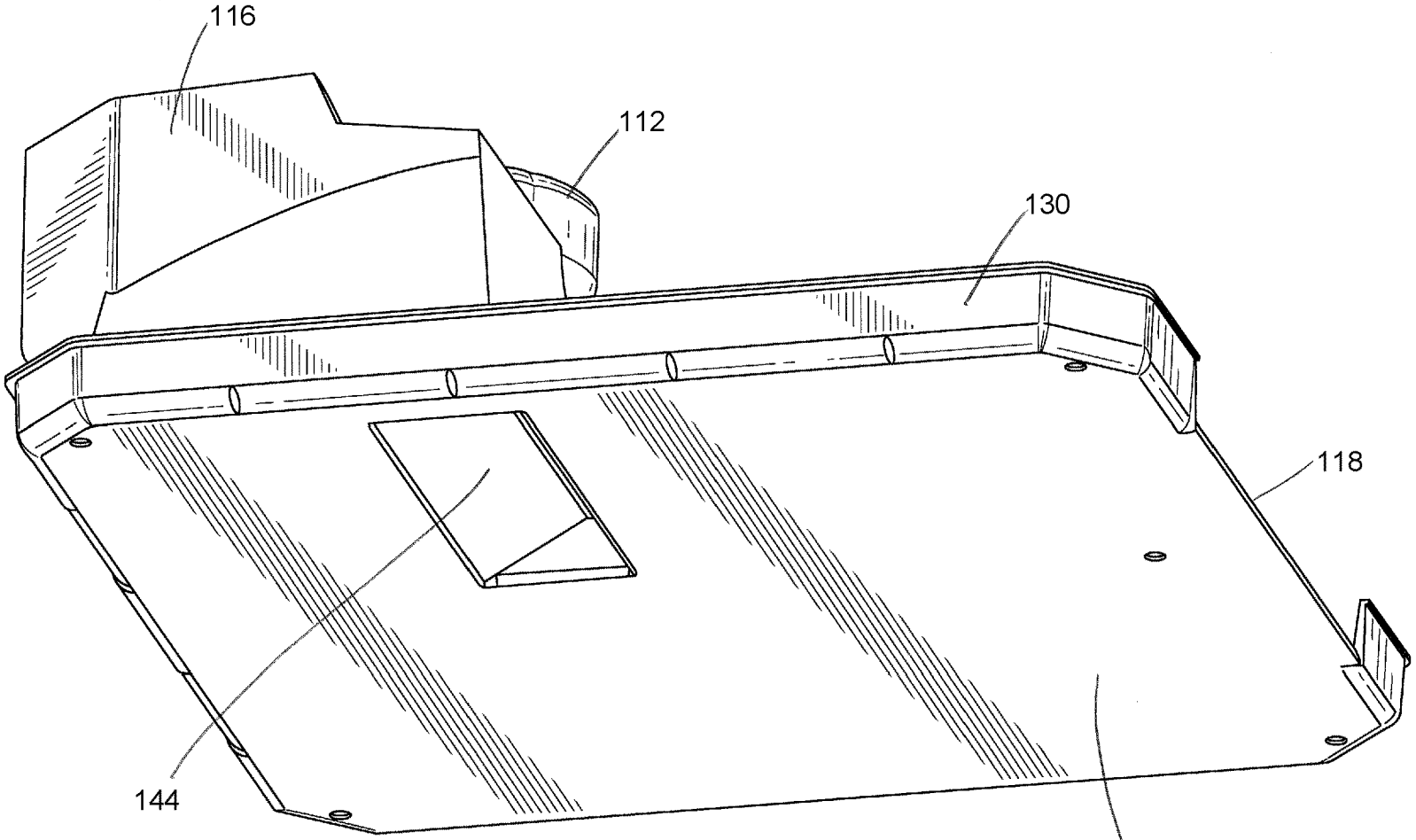
FIG. 14 is a perspective view of the holding tank and floor assembly of FIG. 13, showing the underside of the retention block and upturned flanges of the floor.
Figure 15:
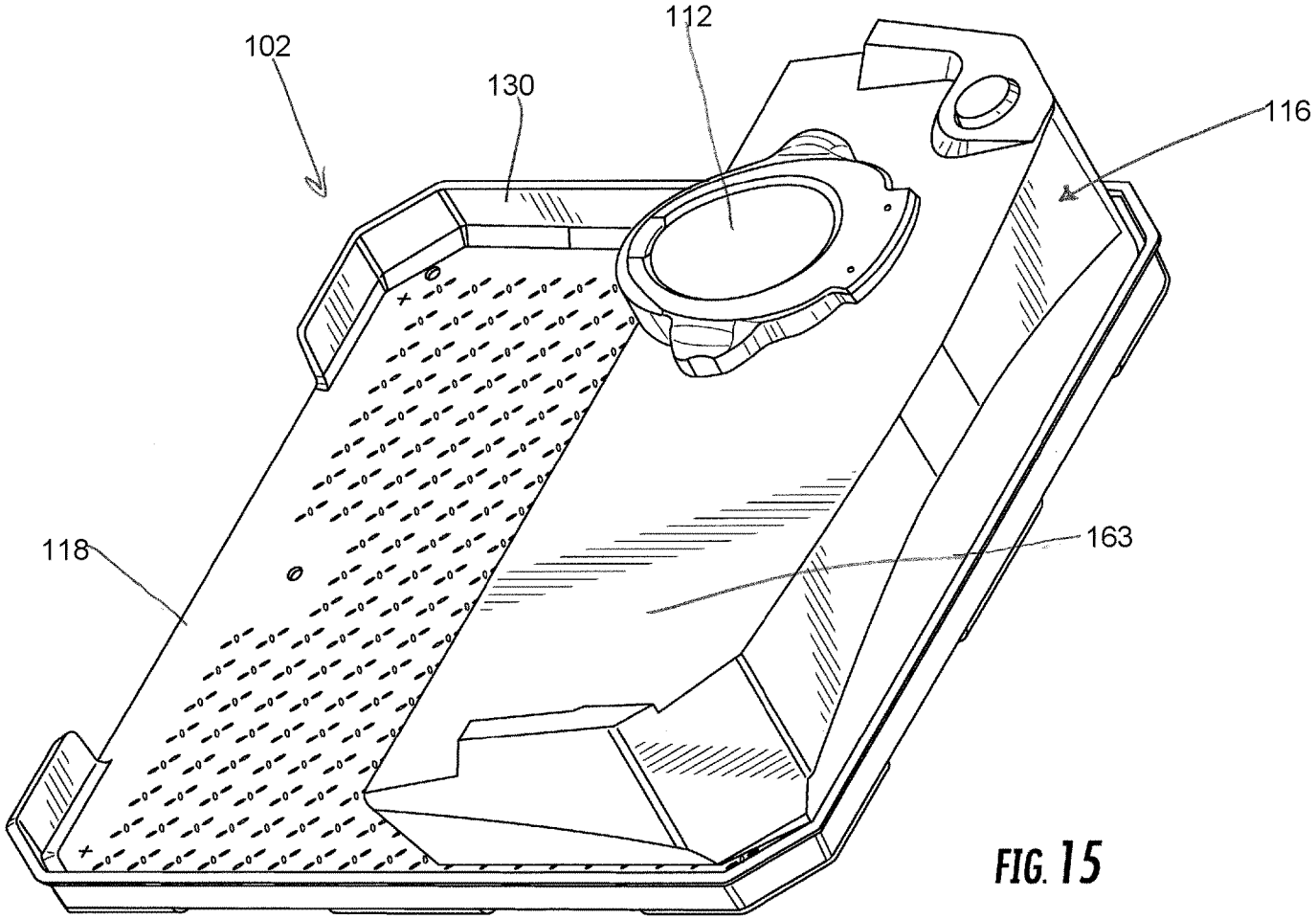
FIG. 15 is an alternative perspective view of the holding tank and floor assembly of FIG. 13.
Figure 16:
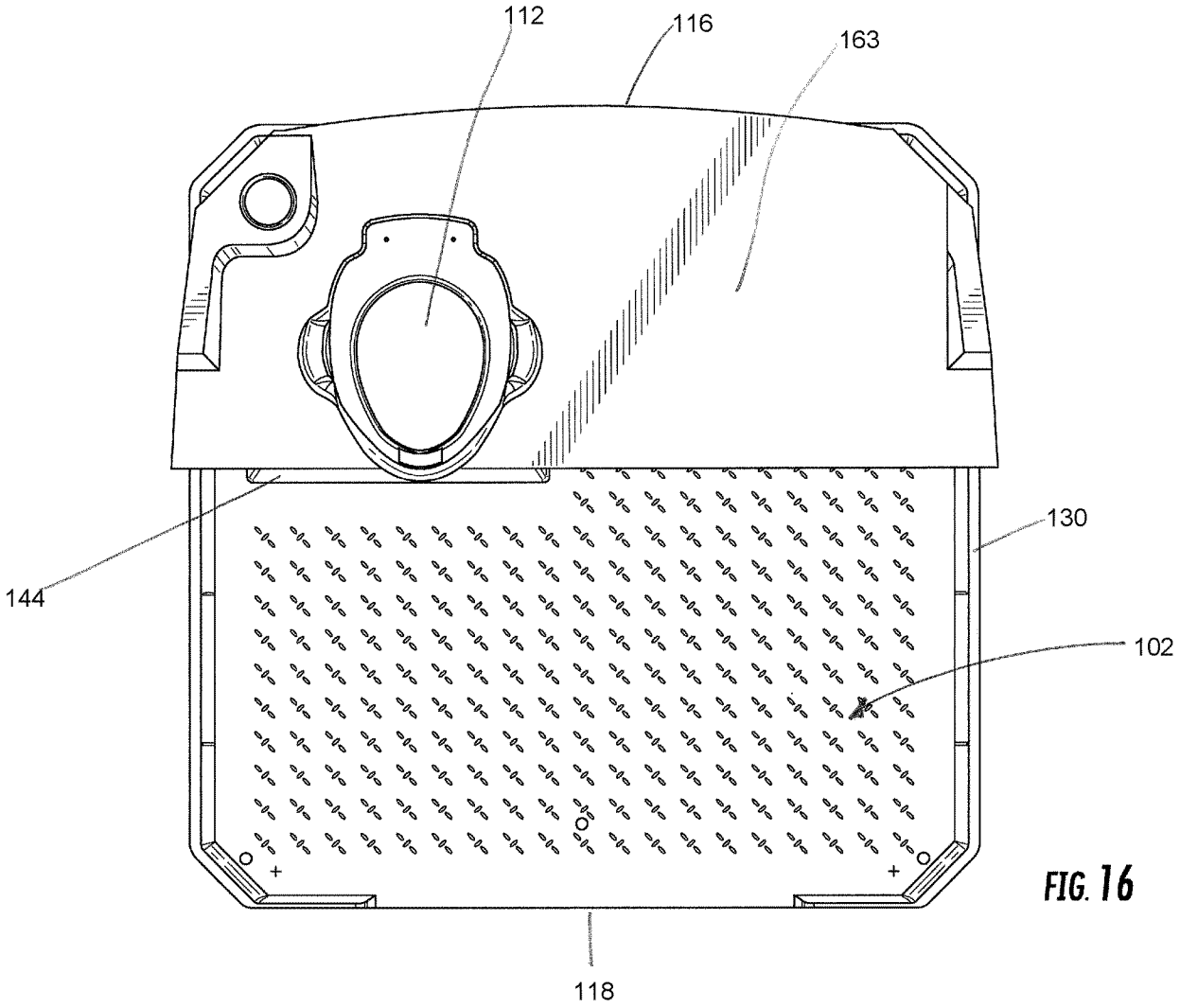
FIG. 16 is a top plan view of the holding tank and floor assembly of FIG. 13.
Figure 17:
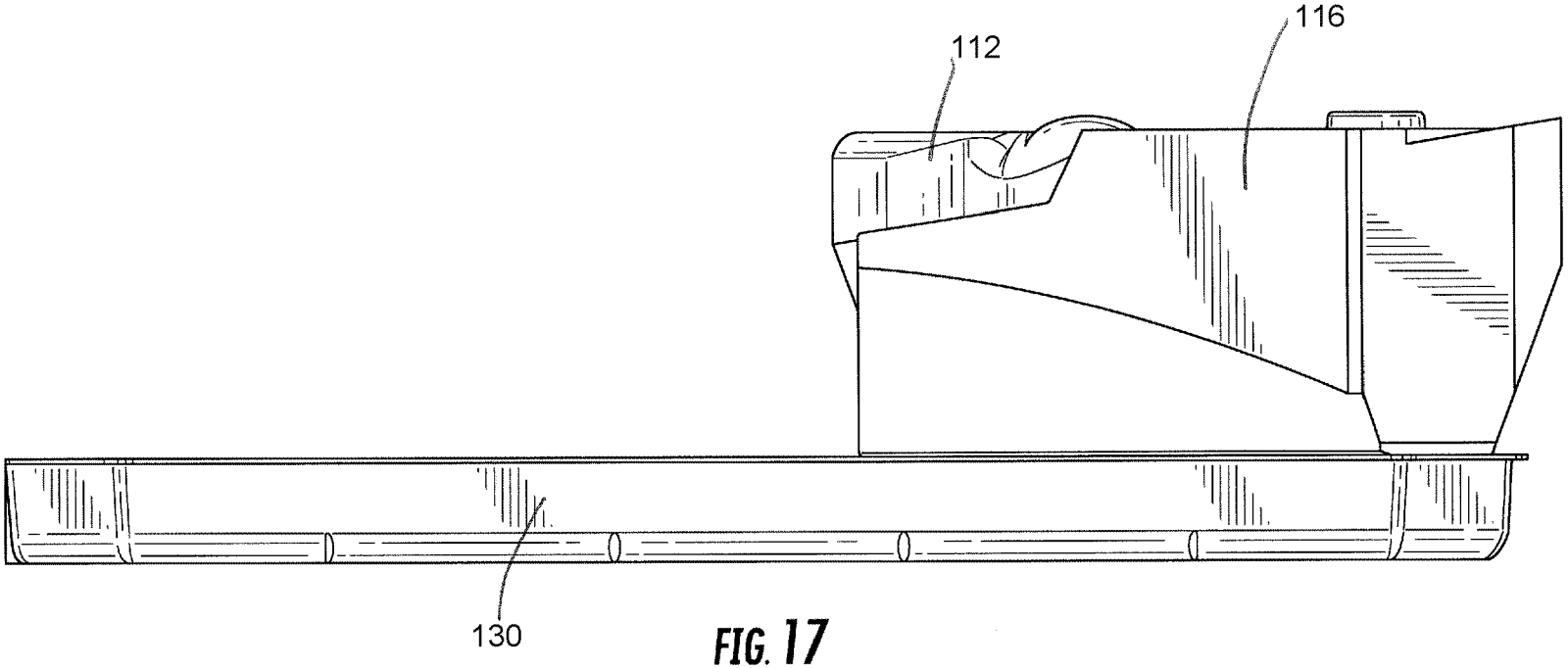
FIG. 17 is a side elevation view of the holding tank and floor assembly of FIG. 13.
Figure 18:
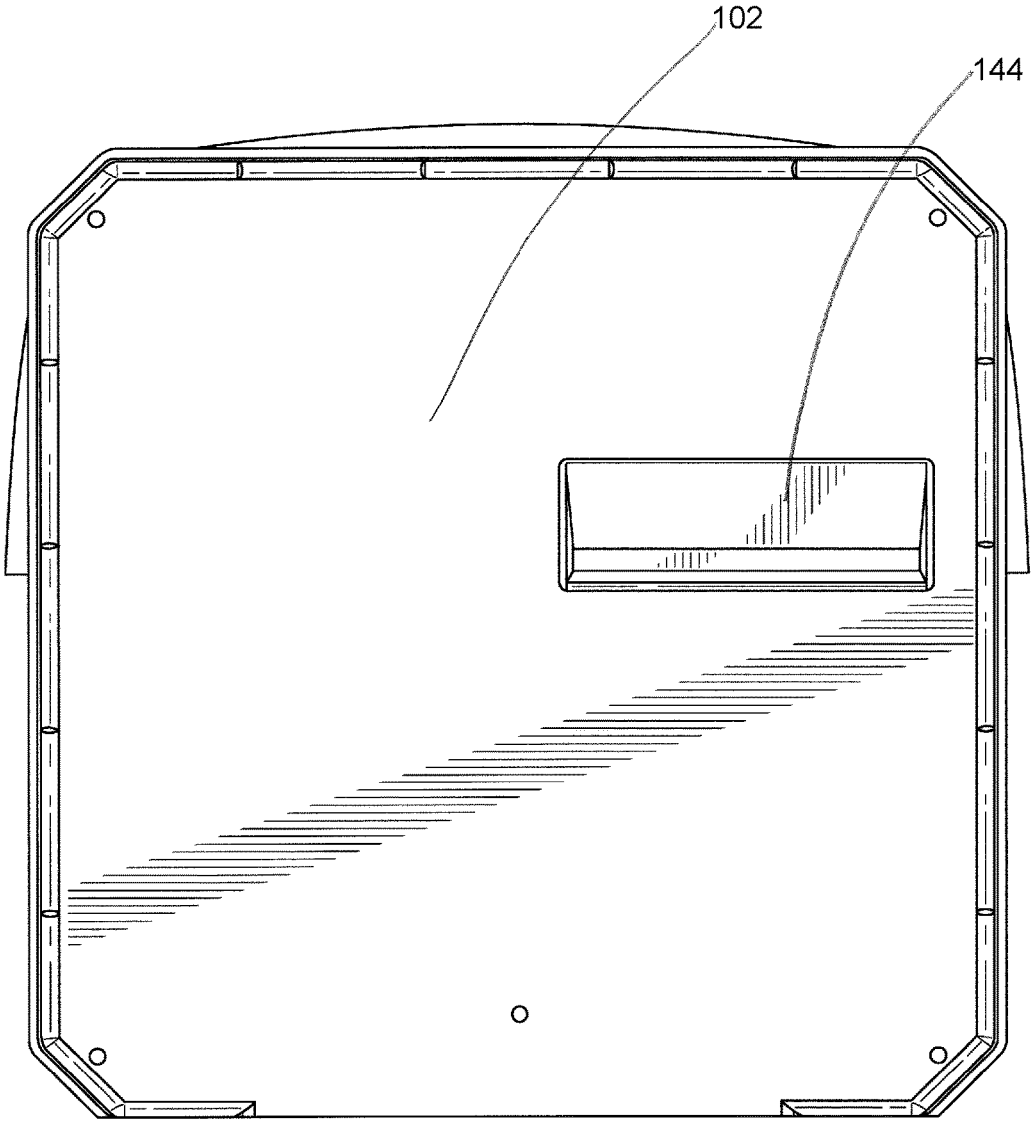
FIG. 18 is a bottom plan view of the holding tank and floor assembly of FIG. 13.
Figure 19:
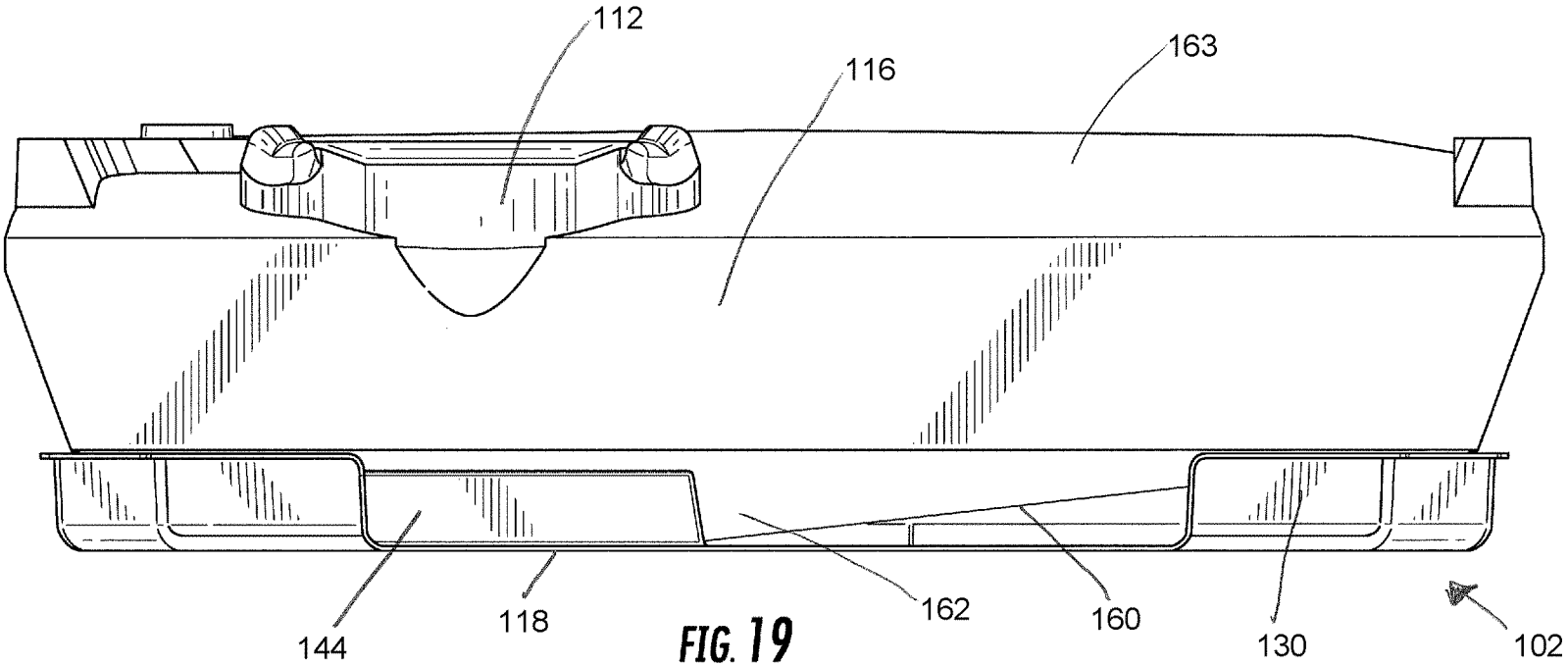
FIG. 19 is a front elevation view of the holding tank and floor assembly of FIG. 13.
Figure 20:
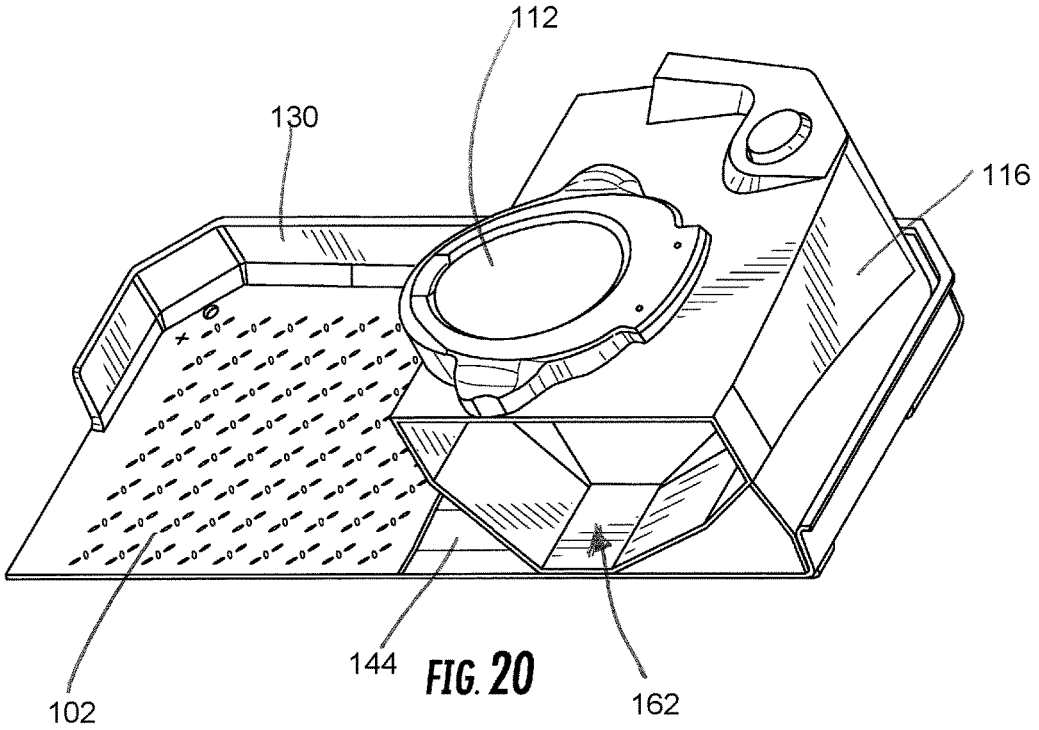
FIG. 20 is a cut-away perspective view of the holding tank and floor assembly of FIG. 13, showing the sump within the holding tank.
Figure 21:
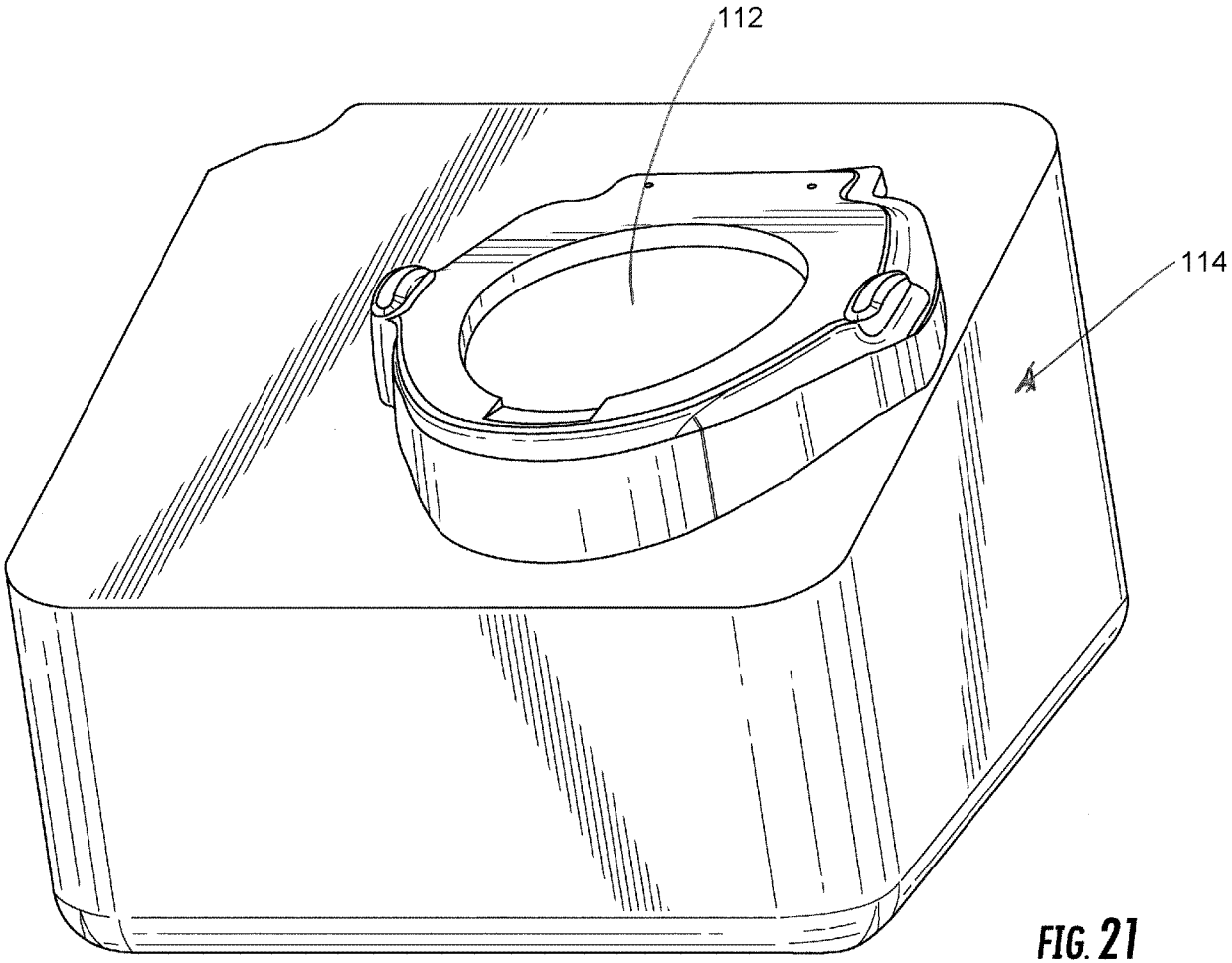
FIG. 21 is a perspective view of an alternative example of a holding tank with sump for use with the portable restroom described herein.
Figure 22:
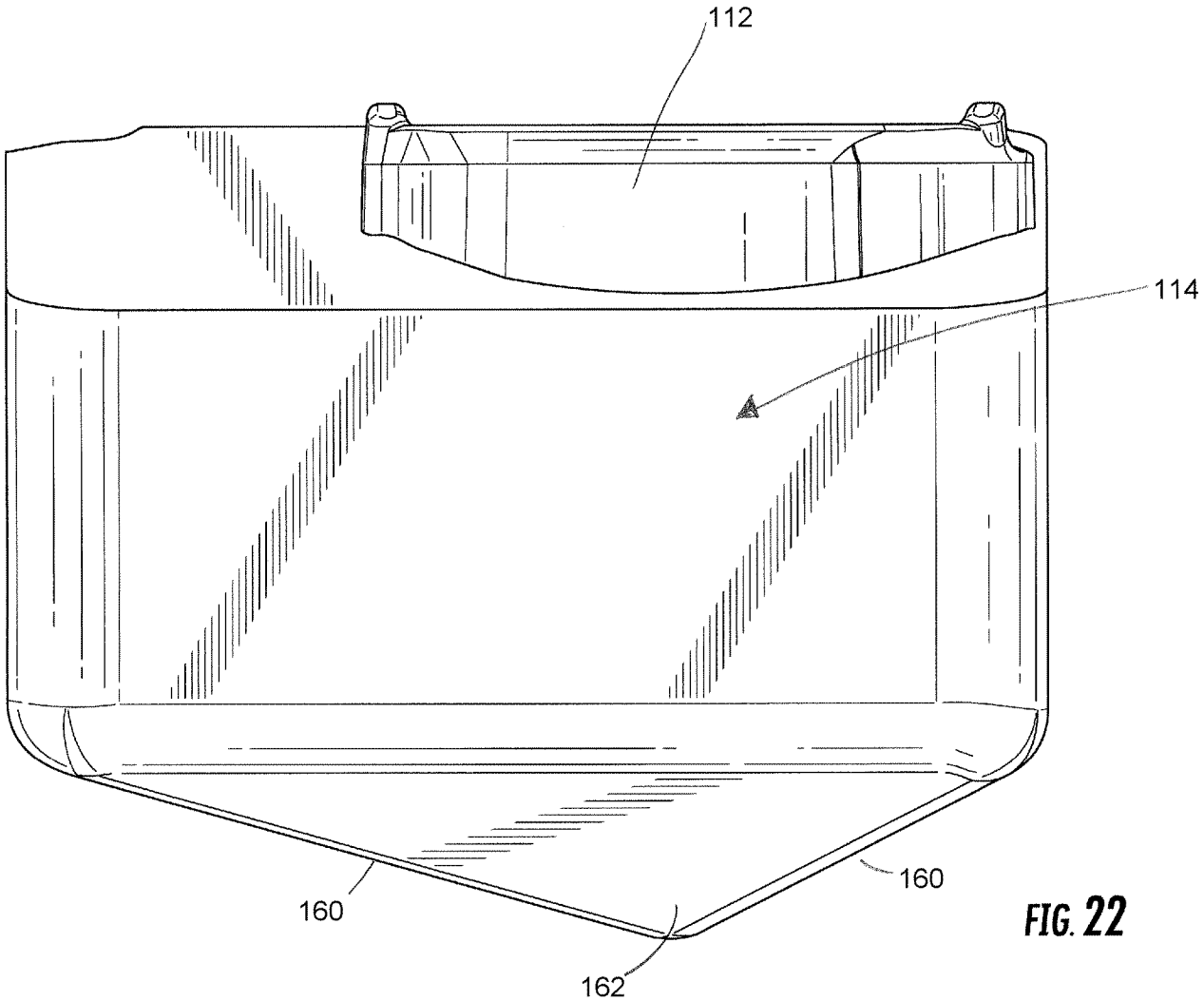
FIG. 22 is a front elevation view of the holding tank shown in FIG. 21, showing the sump.
Figure 23:
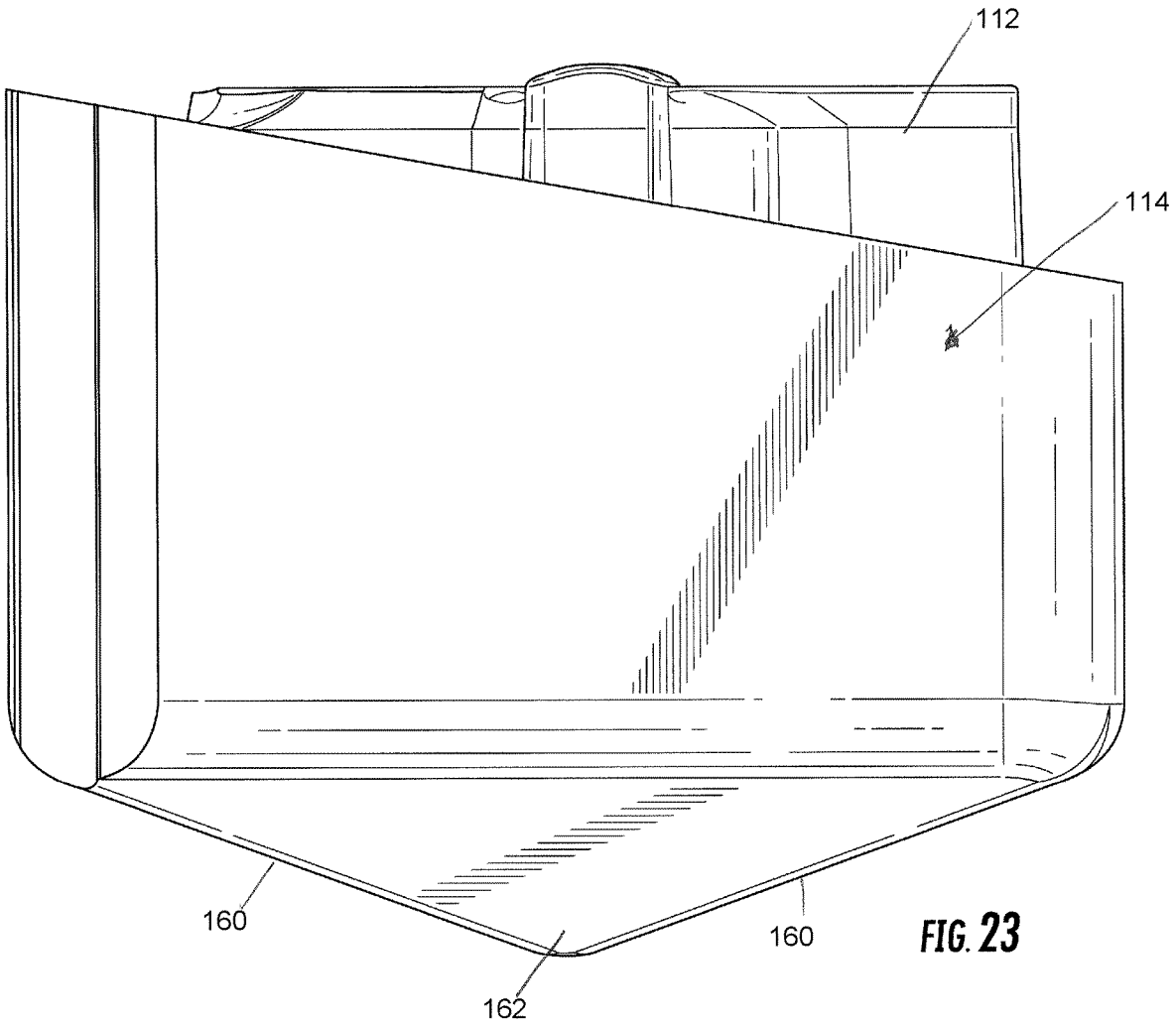
FIG. 23 is a side elevation view of the holding tank shown in FIG. 21.
Figure 24:
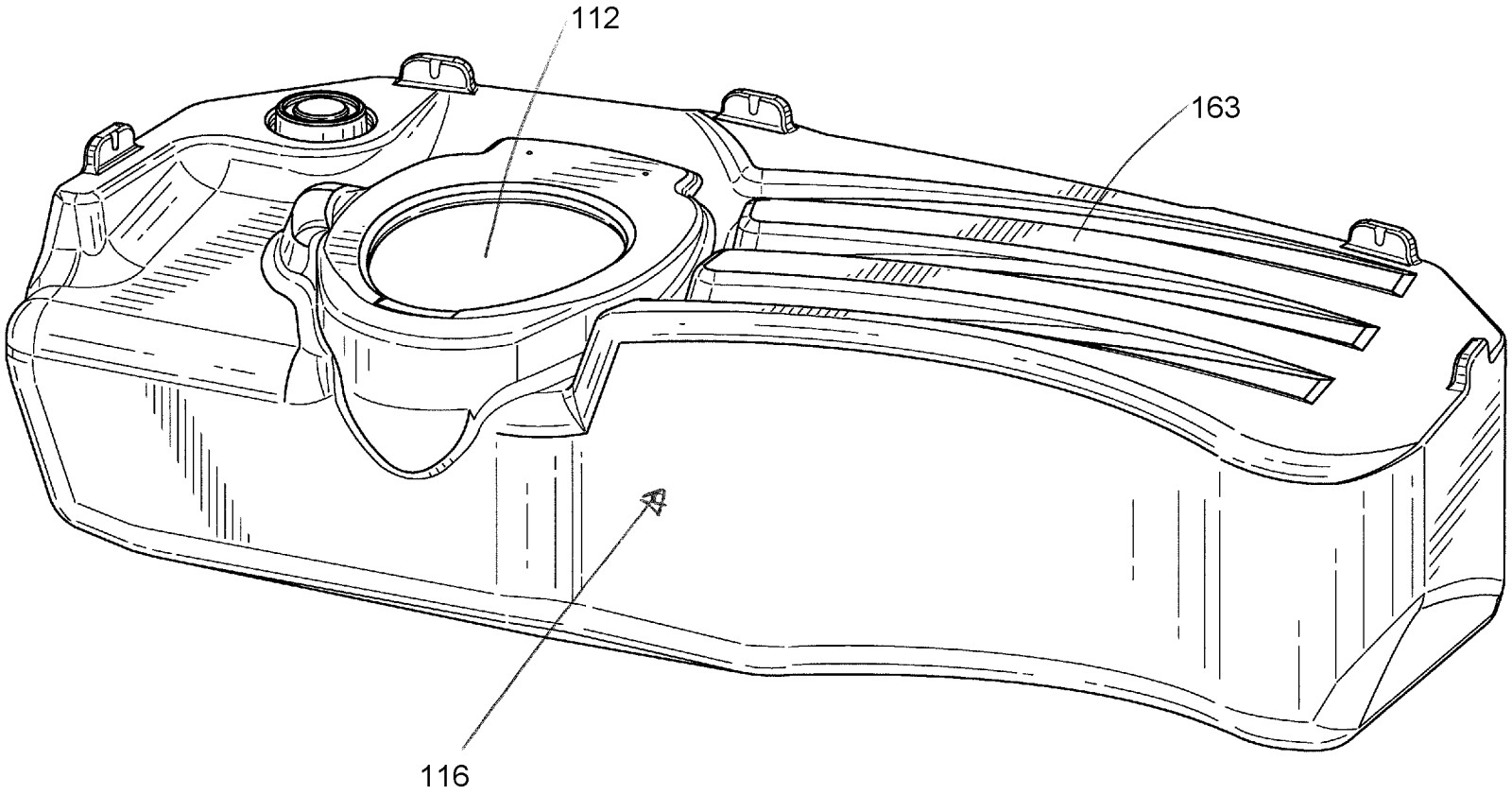
FIG. 24 is a perspective view of an alternative example of a holding tank with sump for use with the portable restroom described herein.
Figure 25:
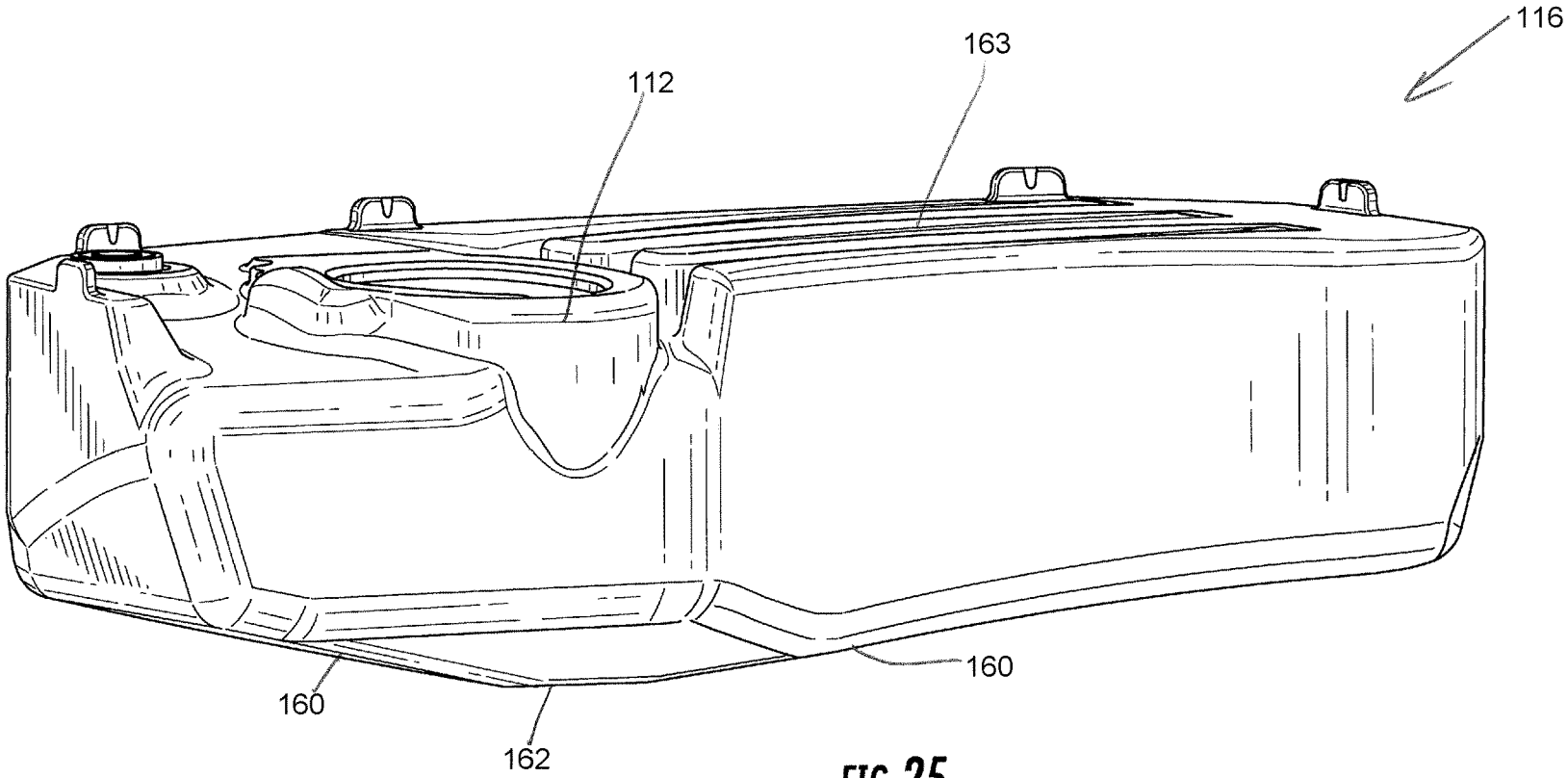
FIG. 25 is an alternative perspective view of the holding tank shown in FIG. 24.
Figure 26:
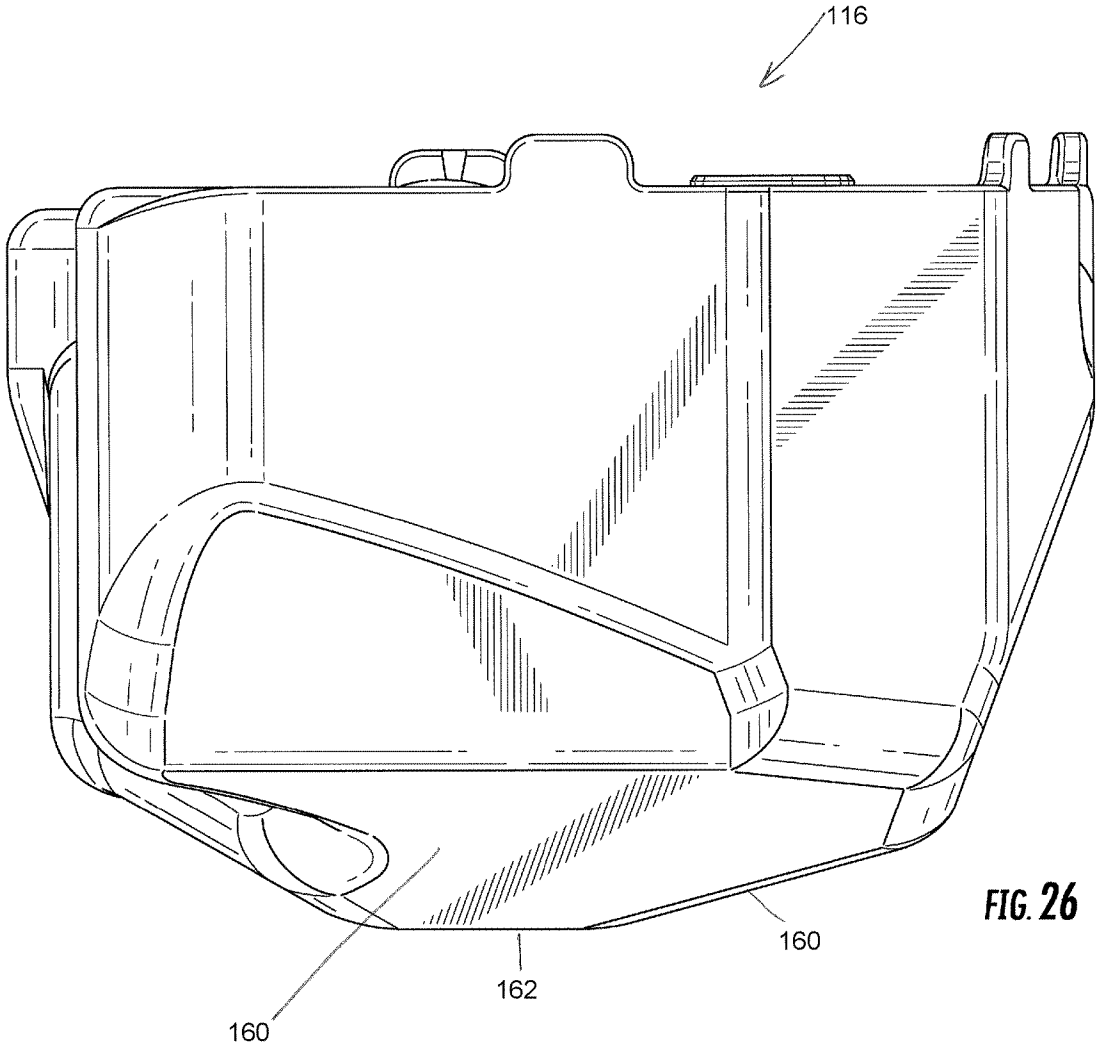
FIG. 26 is a side elevation view of the holding tank shown in FIG. 24.
Figure 27:
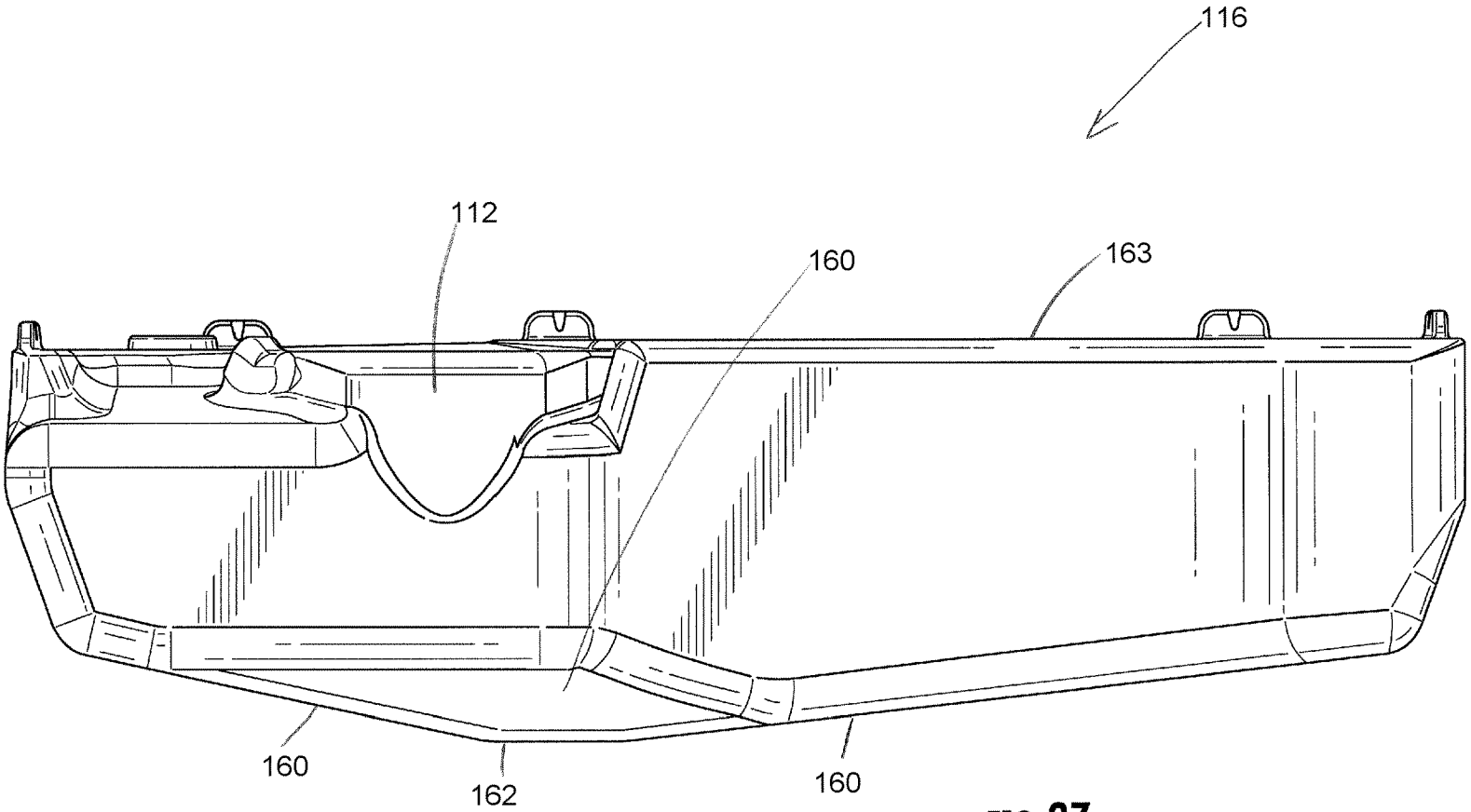
FIG. 27 is a front elevation view of the holding tank shown in FIG. 24, showing the sump.

In addition to the foregoing, portable restroom floors 102 according to one or more examples described herein may have alternative formed wall mounting flanges. These flanges provide improved stiffness and impact resistance. The alternate flange(s) 132 may be used in combination with any one or more of the components and features described herein. An example of an alternative formed wall mounting flange 132 of the type described is shown in FIGS. 11-12. As can be seen, the flange 132 is formed of a double bend 134 and/or a single bend/stiff rib 136. Referring to FIG. 11, the floor 102 may include an upwardly extending flange 132 which is formed of a double bend 134 or wall flange that is integrally formed with the floor 102. On a surface of the flange 132 a sidewall 104 may be joined. The sidewall 104 may be joined to the flange 132 exterior or may be joined to the flange 132 interior. A fastener 138 may extend through the sidewall 104 and the flange 132, 134 to secure the sidewall to the floor flange. A further alternative example of a flange 132 is shown in FIG. 12, which flange may be used in combination with any one or more of the components and features described herein. More specifically, FIG. 12 shows a single bend wall flange with a stiffening rib 136. As can be seen the single bend wall flange and stiffening rib 136 are formed integral with the floor 102. The single bend wall flange is an upwardly extending flange having at its top a stiffening rib which, in the illustrated embodiment, is bent so as to be approximately parallel with the floor 102 (although such an alignment is not required). One example of a feature provided by the stiffening rib is that it advantageously helps maintain straightness along the length of the wall flange. While specific examples are provided for purpose of illustration, variations thereon may also be suitable for the intended purposes.

Figure 3:
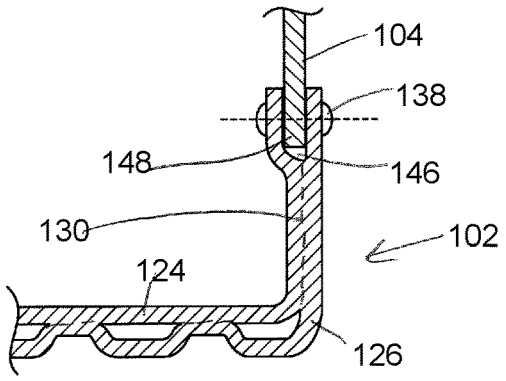
FIG. 3 illustrates a cut-away sectional view of the portable restroom shown in FIG. 2, taken from a section of FIG. 2, according to one or more examples of embodiments.
Figure 4:
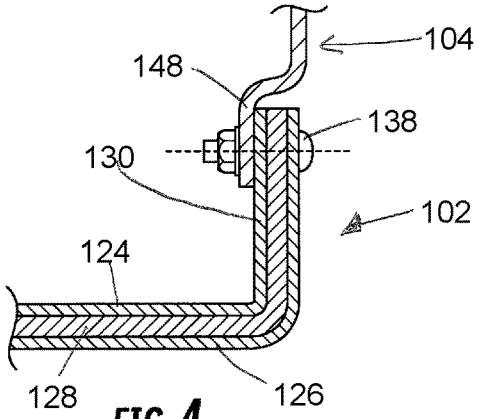
FIG. 4 illustrates an alternative cut-away sectional view of the portable restroom shown in FIG. 2 and section shown in FIG. 3, according to one or more alternative examples of embodiments, showing a floor comprising a solid or foam core material.

As indicated above, in one or more examples of embodiments the floor 102 may be formed of two plastic sheets 124, 126 secured together. This assembly offers or may be provided with a secure groove 146 into which the sidewall 104 and/or other vertical components may be securely fastened. Such a groove 146 may also be provided on a solid sheet floor 102 (e.g., single sheet floor such as described hereinabove). As can be seen in FIG. 3, in one or more examples of embodiments the flange 130 extends upwards and has a slot or groove or recess 146 which engages the lower end 148 of the sidewall 104. In the illustrated example, a fastener 138, or more than one fastener, extends though the flange 130 on first and second sides of the slot or groove 146 as well as through the sidewall 104 received in the slot or groove so as to secure the sidewall 104 to the base 102. While fasteners are described, other means of securing the wall to the floor 102 may also be used, such as but not limited to adhesive, friction fit, tongue and groove, and the like. In an alternate example of embodiments, an example of which is shown in FIG. 4, the floor 102 may be comprised of a solid or foam core. In this example, the flange 130 may not include a slot or groove. Instead, the sidewall 104 may have a shaped lower end (and/or the flange may have a shaped upper end) which aligns with one or more side surfaces of the flange 130, such as the inner side surface of the flange and extending upward and over the top of the flange. In this embodiment, a fastener 138, or more than one fastener, may extend through the flange 130 and through the end of the shaped lower portion so as to secure the sidewall 104 to the base 102.

In addition, special accommodations or recesses or cut outs 150 (see FIG. 2) may be formed into the floor 102 to invite lift truck fork entry at specific locations about the bottom of the floor 102 section. Referring to FIG. 2, the floor 102 of the portable restroom 100 includes a plurality of lift truck fork entry recesses 150. These entry recesses 150 are located to permit the lift truck to access and lift the portable restroom 100 from below while maintaining the lowered floor height of the portable restroom 100.

As indicated, the floor 102 may also be formed or molded to provide, or may include a cradle or nest 152 for the portable restroom holding tank 114 (see e.g., FIGS. 5-7 and FIGS. 10, 13-20). That is, the floor 102 may be formed in such a manner to provide a cradle 152, or a cradle may be molded into the floor 102. The cradle 152 may be provided for securely locating the restroom holding tank 114 within the portable restroom 100 and may further support the holding tank 114 thereon. The holding tank 114 may be fastened to the cradle 152 or may be rested thereon without fastening.

Figure 5:
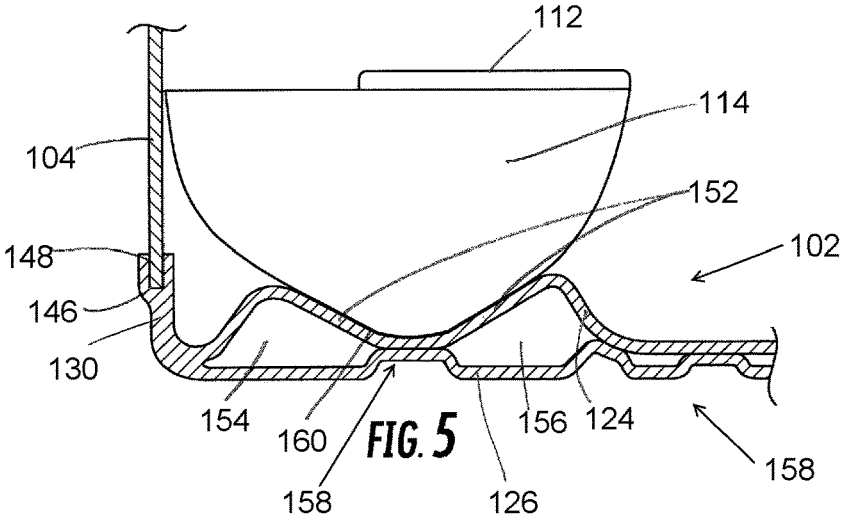
FIG. 5 illustrates a cut-away side elevation view of the portable restroom of FIG. 2 according to one or more examples of embodiments, showing a floor formed of twin sheet material having a hollow core, and showing a tank cradle supporting a holding tank of the portable restroom.
Figure 6:
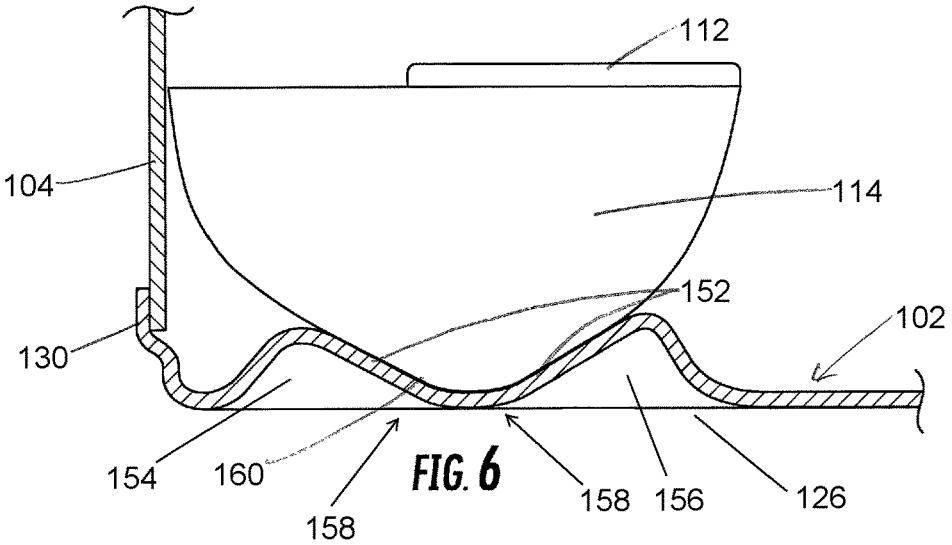
FIG. 6 illustrates a cut-away side elevation view of the portable restroom of FIG. 2 according to one or more examples of embodiments, showing an alternative example of a floor, wherein the floor is a solid sheet, and also having a molded in tank nest or cradle.
Figure 7:
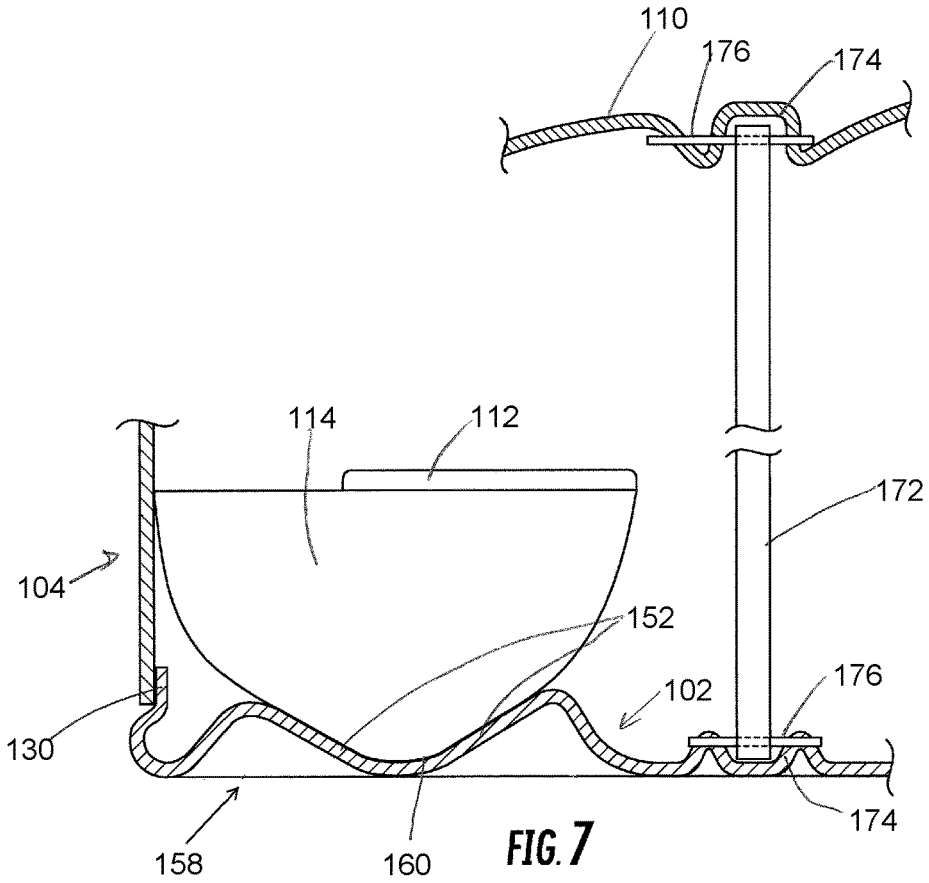
FIG. 7 illustrates one or more examples of restraints positioning and retaining a vertical grab bar in the portable restroom shown in FIG. 2.

In one example, shown in FIGS. 5-7, the floor 102 has a shaped upper surface or cradle or nest 152 near a sidewall 104 and flange 130 which aligns with the bottom of the holding tank 114. In the illustrated example, the shaped upper surface 152 is formed by first and second hollow core areas 154, 156 separated by a central double-sheet floor area 158. In another example, shown in FIGS. 10, 13-20, the floor 102 has a protrusion or block 144 extending from the floor 102 forming the cradle 152 or a portion of a cradle or nest for the holding tank 114. To this end, the block 144 mounts or assists in supporting the tank 114 above the floor 102.

The tank 114, in one or more examples of embodiments, is provided with a lower sidewall 160 or more than one such lower sidewall 160 which is/are matingly shaped to engage the protrusion 144 in the floor 102 in order to nest the tank 114 in position in the portable restroom 100. Examples of such an arrangement are shown in FIGS. 13-20 in which a full size or max tank 116 (which extends from sidewall 104 to sidewall 104) is shown engaged with the floor protrusion 144 in an accessible portable restroom 100. Various examples of holding tanks (114, 116) are shown in FIGS. 13-27. FIGS. 21-24 show an example of a smaller holding tank 114 for use with a portable restroom 100. FIGS. 24-27 show an example of a max or full size holding tank 116. Each of said holding tanks 114, 116 includes the primary components described herein, but is differently sized or shaped for the applicable portable restroom dimensions. Accordingly, like reference numerals are used to illustrate like components.

To this end, the floor 102 of the portable restroom 100 is also provided one or more advantageous features over existing structures. As can be seen by reference to these Figures, in one or more examples of embodiments of the accessible portable restroom 100 described herein, the holding tank 114, 116 is provided with a sump 162 (a pit or depression) in the base of the tank 114, 116. In comparison, existing ADA style or accessible portable restrooms have a tank with a flat base. Consequently, a sump has not been possible in such existing restrooms. In contrast, the floor 102 of the present invention includes a protrusion 144 or block which mounts the holding tank 114, 116 above (or upon) the floor 102 (see FIGS. 13-20). As a result, the holding tank 114, 116 may have a sump 162. Various examples of a holding tank 114, 116 and sump 162 are shown in FIGS. 13-27. As can be seen, the sump 162 extends below an imaginary horizontal plane formed by the bottom edge of the sidewalls 104, and forms a low point or pit in the holding tank 114, 116. The sump 162 provides a mechanism by which solid waste gravitates to a low point such that it is easy to remove and clean. It can also be seen in the tanks 116, that a seat area or platform 163 is provided on an upper surface of the tank, which may be used by the occupant.

Figure 28:
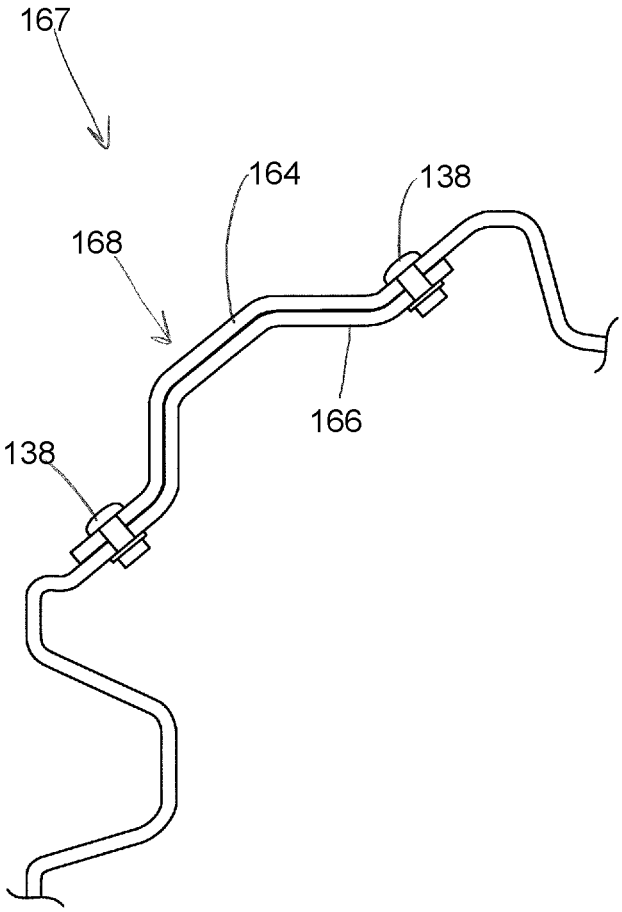
FIG. 28 is a top cut-away view of a corner assembly for use with the portable restroom as described herein.
Figure 29:
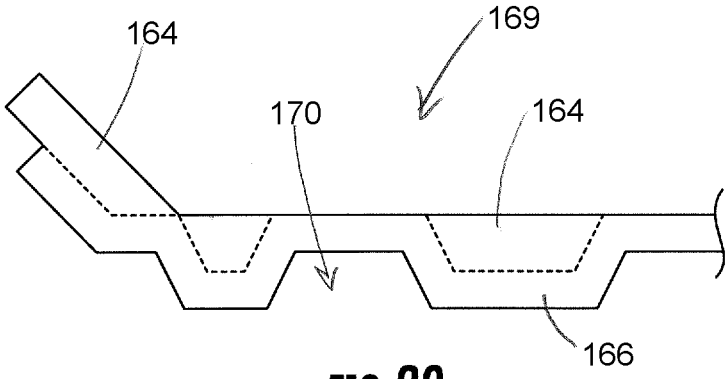
FIG. 29 is a cut-away view of an air slot or roof and wall panel assembly for use with the portable restroom as described herein.

In addition to the foregoing, one or more improved portable restroom joints or corners 167 (e.g., wall-to-wall, wall-to-roof, wall-to-base, wall-to-door jamb, roof-to-door jamb) are provided. Referring to FIGS. 28-29, the improved joints 167 comprise a plurality of nested sheets, such as for example, at least two nested plastic sheets 164, 166. These plastic sheets 164, 166 are molded or otherwise shaped to fit or nest together. According to one or more examples of embodiments, the sidewalls 104 of the portable restroom 100 are provided with matching/mating/nesting portions 164, 166 such that they may be mated as described herein. The sheets may then be connected together (e.g., by fasteners 138) to secure them in place. For example, as can be seen in FIG. 28, a corner 167 of the portable restroom 100 may be provided each with an angled segment, such as a 40 to 45 degree angle segment, or mounting flange 164 which overlaps and nests with an adjacent segment or mounting flange 166 shaped and/or angled to align with the angled segment or mounting flange 164. In the illustrated example shown in FIG. 28, the mounting flange 164 and/or 166 may also have a protrusion or recessed surface 168 between fastener points. Likewise, in FIG. 29 the wall-to-roof assembly 169 may be provided with a corresponding or nesting shape in both the roof connecting portion and the top portion of the sidewall(s) to form one or more air slots 170 for ventilation. To this end, a portion of the sidewall 104 and roof 110 may nest together, while a portion may provide an air gap or slot 170 or channel for the passage of air.

Figure 34:
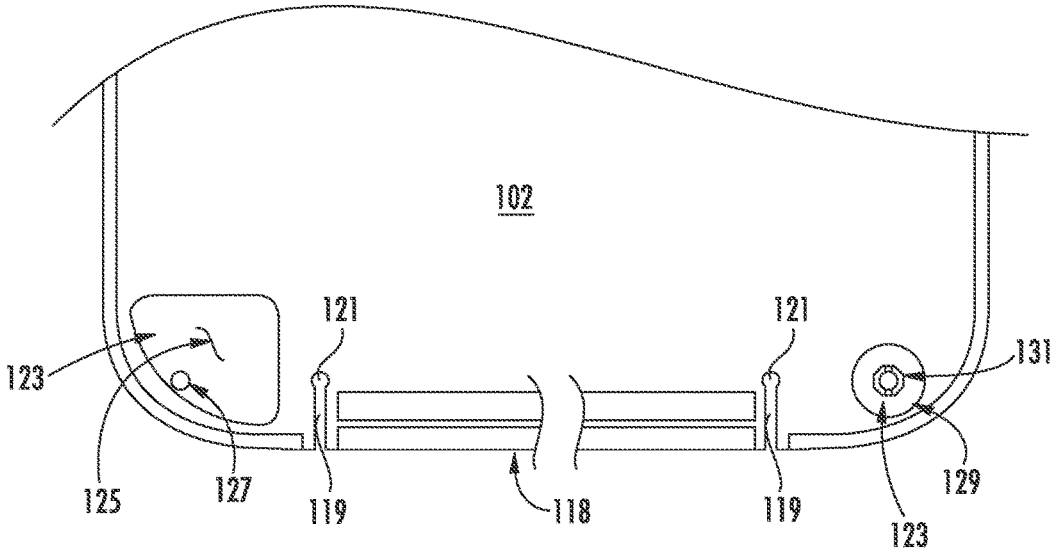
FIG. 34 is a cut-away, split, top plan view of a restroom floor according to two different examples of embodiments, showing on the left hand side a first example of a restroom floor according to one or more examples of embodiments and on the right hand side a second example of a restroom floor according to one or more examples of embodiments.
Figure 35:
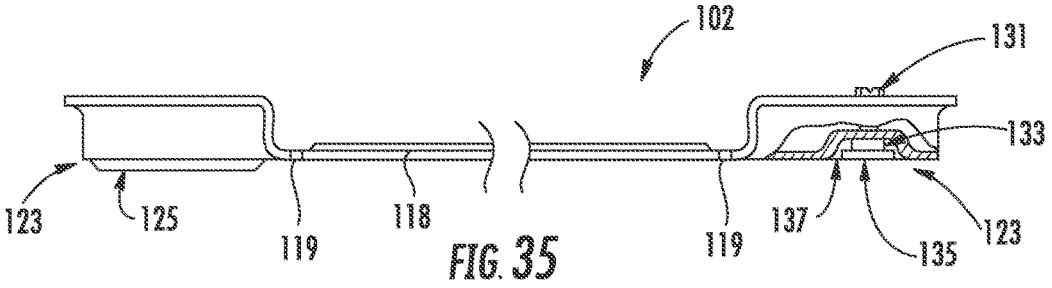
FIG. 35 is a cut-away, split, side elevation view of the restroom floor shown in FIG. 34, showing on the left hand side a first example of a restroom floor according to one or more examples of embodiments and on the right hand side a second example of a restroom floor according to one or more examples of embodiments.

As indicated, the floor 102 includes a low opening or threshold 118 for easy access to the restroom 100, such as but not limited to access by a wheelchair. In one or more examples, the floor 102 may be an approximately flat plastic sheet. The floor 102 may have a surface feature to reduce slippage. To reduce the likelihood of bowing of the flat floor 102 and threshold 118 due to uneven or irregular surfaces upon which the restroom 100 is placed or due to thermal conditions affecting the stresses within the floor and/or threshold material—which may cause a safety hazard among other concerns—one or more self-leveling door threshold solutions are provided as shown in FIGS. 34-35. For purposes of illustration and discussion herein, FIGS. 34-35 represent split views, showing two different examples of self-leveling solutions or devices, namely, one on the left and one on the right. However, it is contemplated that both the left and the right side of the floor 102 may include the same or different self-leveling solutions or devices. Likewise, it is contemplated that self-leveling solutions or devices may be employed in other locations of the floor 102 which accomplish the same purposes, such as but not limited to the edge of the floor opposite the threshold 118.

To this end, a portable restroom having a floor structure is provided. The floor structure comprises a sheet of material forming a floor 102, the material having an upturned flange 130 surrounding its perimeter. A threshold 118 is formed by a recess in the upturned flange 130 on the perimeter of the sheet of material. One or more self-leveling devices, described in greater detail hereinbelow, are provided for leveling the threshold and/or the floor.

As can be seen in said Figures, in one example a self-leveling solution in the form of a threshold stress relief is provided. The threshold stress relief is provided in the form of one or more slits 119 adjacent to the threshold. In the illustrated embodiment, a slit 119 is provided on each side of the threshold 118. The slit(s) 119 isolate the threshold 118 from compressive stresses within the main floor 102 of the restroom 100, allowing the threshold 118 to self-level and to lie flat. The slit(s) 119 may be terminated in a through hole 121. As can be seen on the left-hand and right-hand side of FIGS. 34-35 one or more threshold stress relief slits 119 (and through holes 121) are provided in the floor 102 adjacent to the threshold 118. Accordingly, the self-leveling devices comprise a first slit and through hole on a first side of the threshold and a second slit and through hole on a second side of the threshold, which slits isolate the threshold from compressive stresses and allow the threshold to self-level and lie flat. The stress relief slits 119 may also be provided in combination with the additional features shown in FIGS. 34-35 and discussed below.

In another example of embodiments, the self-leveling device for leveling the threshold and/or the floor comprises a jamb leveler provided in the floor. One or more jamb levelers 123 or pads are provided on one or both sides of the door 106 or door frame 108 or threshold 118. To this end, a plurality of pads are or may be molded into the floor. In one example, the jamb levelers 123 may be provided as features molded into the restroom floor that accommodate leveling devices such as pads, wedges or leveling screws. As can be seen on the left-hand side of FIGS. 34-35, the restroom floor 102 may be provided with a jamb leveler pad 125 molded into the floor 102, and which may extend below the lower surface of the floor, and, optionally, a drain hole 127 in an approximate corner of the restroom 100, adjacent to the threshold 118 of the restroom entryway. As can be seen on the right-hand side of FIGS. 34-35, in an alternative example of embodiments the restroom floor 102 may be provided with a pocket 129 and jack screw 131 which is coupled to or holds a jack screw nut 133 and a pad 135 that may extend below the lower surface of the floor 102. In the illustrated example, the nut 133 and pad 135 may be received on the jack screw 131 within a pocket 137 molded into the floor 102. Although variations thereon may be acceptable for the purposes provided. A plurality of jack screws coupled to pads are, or may be provided in the floor. The jack screw, nut, and pad may be adjustable in height so as to change the height or position (raise and lower) of the pad 135. In one or more examples of embodiments, the pad 125 or 133 may slightly raise the jamb 108 (jamb 108 not shown in FIGS. 34-35). In addition, it may accommodate additional leveling devices, such as but not limited to wedges or blocks (not shown).

While specific examples of self-leveling devices are shown, it is contemplated that variations thereon may be made without departing from the overall scope of the present invention.

Figure 8:
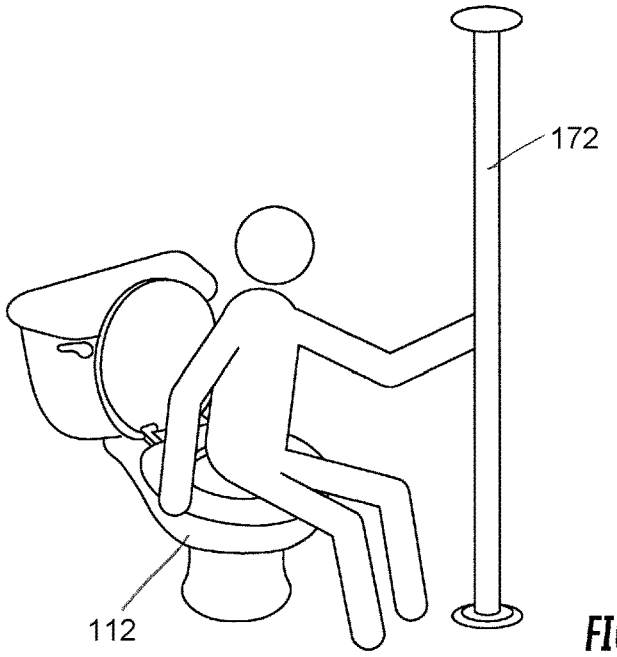
FIG. 8 illustrates an example of a vertical grab bar in use by a user on a standard toilet for purposes of illustrating an example of such a device.

Referring again to FIG. 2, additional restroom features are shown. FIG. 2 illustrates a horizontal grab bar 120. Also shown in FIG. 2, and further detailed in FIGS. 7-8, is a vertical grab bar 172. The respective grab bars 120, 172 may be made of high impact yet flexible tubing. Examples may include any suitable, durable, cleanable/sanitary material, one example of which is sanitary grade stainless steel, but alternatively may be molded plastic (or for example, polyvinyl chloride (PVC) pipe). In one or more examples of embodiments, the horizontal grab bar 120 and/or vertical grab bar 172 may be located near the toilet 112 as may be required by ADA and/or ANSI standards. The horizontal grab bar 120 may be any suitable length as required by said standards or other manufacturing and/or space requirements.

In one or more examples of embodiments, a vertical grab bar 172 may be mounted to a sidewall 104 and positioned near the toilet 112 according to ADA and/or ANSI standards. Referring to FIG. 7, in the illustrated embodiment, the vertical grab bar 172 is mounted to the floor 102 and ceiling of the portable restroom 100, and extends the entire length therebetween. In particular, molded-in pockets 174 may be provided in the floor 102 and the roof 110 of the portable restroom 100. Alternatively, hardware of similar functionality/geometry may be used to fasten the vertical grab bar 172 to the floor 102 and/or ceiling of the portable restroom 100. These pockets 174 are vertically aligned and sized to receive an end of the vertical grab bar 172 or pole. Fasteners 176 may be provided extending through at least a portion of the respective pocket 174 and grab bar end to secure the vertical grab bar 172 in position. While specific examples are provided, one of skill in the art would understand that variations in dimensions and distances may be made for purposes of compliance with particular standards or regulations or for other structural purposes.

Referring to FIGS. 30-33A, grab bar mounts 178 or supports molded as integral components of a portable restroom sidewall 104 are shown for retention of a horizontal grab bar 120. While not specifically described, it is contemplated that grab bar mounts 178 or supports may also be molded as integral components of the door 106 and/or door jamb(s) 108. As shown herein, one or more grab bar mounts 178 are molded into the restroom sidewall 104, and may be molded into each or any sidewall 104. It is also contemplated that grab bar mounts may be formed and separately attached to the sidewall. Each mount 178 extends inward into the interior of the portable restroom 100 and is positioned at a height suitable for grab bar 120 positioning for use. If a plurality of mounts 178 are provided, the mounts 178 are aligned for support of the grab bar 120 along its length. For example, a plurality of mounts 178 may be horizontally aligned. In the illustrated example shown in FIGS. 31-32, the grab bars 120 are mounted to the side and rear walls 104, 104*a* using various horizontally spaced apart grab bar mounts 178.

The grab bar mounts 178 may be formed by any suitable means. In one example of embodiments, the grab bar mounts 178 may be integrally molded with the sidewall 104 or wall panel. According to one or more examples, a grab bar mount 178 comprises first and second sides 180, 182 joined to, and by, a third side 184. The third side 184 may be approximately perpendicular to the first and second sides 180, 182. The first, second, and third sides 180, 182, 184 generally form a shape comprising a lower segment 186, which may be a tapered or sloping portion, an upper segment 188, which may be tapered or a sloping portion and a grab bar receptor 190 positioned between the lower and upper segments 186, 188. While tapered or sloping segments are specifically illustrated, it is contemplated that either or both said segments may be formed of curved and/or straight segments. The grab bar receptor 190 illustrated in the figure comprises a curved or recessed area corresponding to the shape and approximate dimension of the grab bar 120. To this end, the grab bar receptor 190 may be shaped to receive and retain the grab bar 120 (e.g., a snap fit or friction fit). The grab bar 120 may also or alternatively be coupled at or to the receptor(s) 190 by one or more fasteners (not shown). Alternatively, the grab bar mount 178 may include one or more apertures therethrough which may form the grab bar receptor 190 through which the grab bar 120 may be received/inserted.

Figure 31:
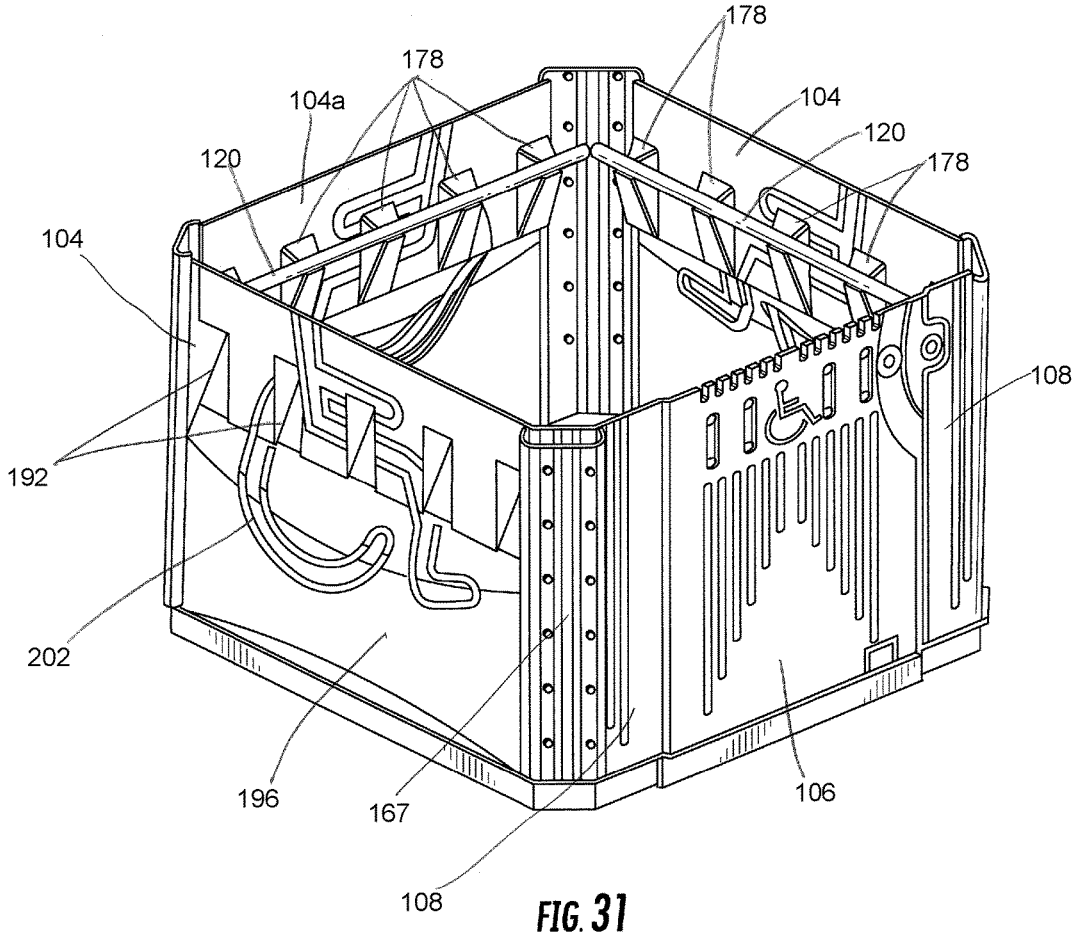
FIG. 31 illustrates a cut away perspective view of the portable restroom shown in FIG. 30, showing grab bars mounted to grab bar support mounts on sidewall and rear wall of the portable restroom.
Figure 32:
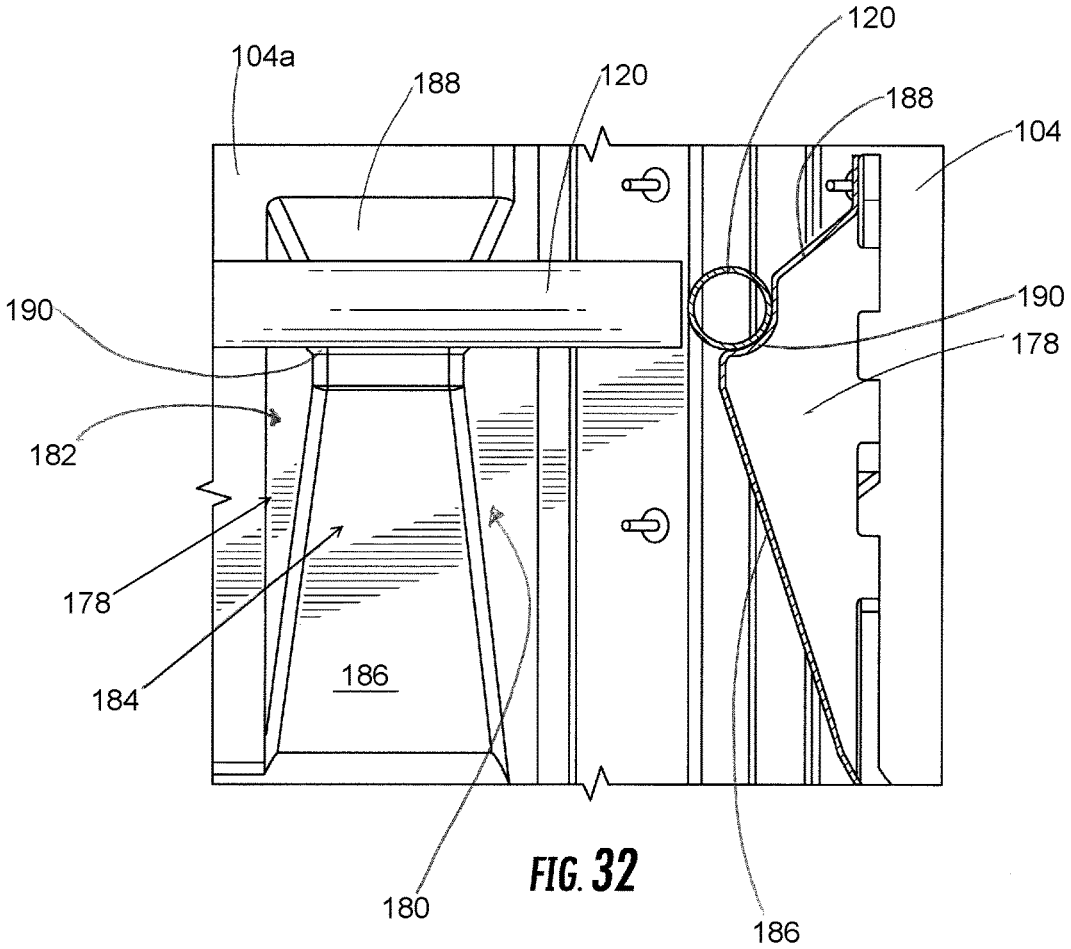
FIG. 32 illustrates a partial cross-sectional view of the portable restroom shown in FIG. 30, illustrating a cross-section of a sidewall grab bar mount and a front elevation view of the rear wall grab bar mount and the corresponding grab bars mounted thereon.

According to one or more examples of embodiments, the grab bar(s) 120, 172 may be a high impact, yet flexible tubing, providing lighter weight and more durability. The grab bar 120, 172 in one or more examples of embodiments is a plastic tube ranging from 1 to 2 inches in diameter, such as for example a 1.5 inch diameter PVC tube, although variations thereon accomplishing the intended purposes may also be acceptable. As shown in FIGS. 31-32, the grab bar 120 of one sidewall may be mounted at the same height as a grab bar 120 on an adjacent wall (e.g., the sidewall 104 and rear wall 104*a*).

Figure 30:
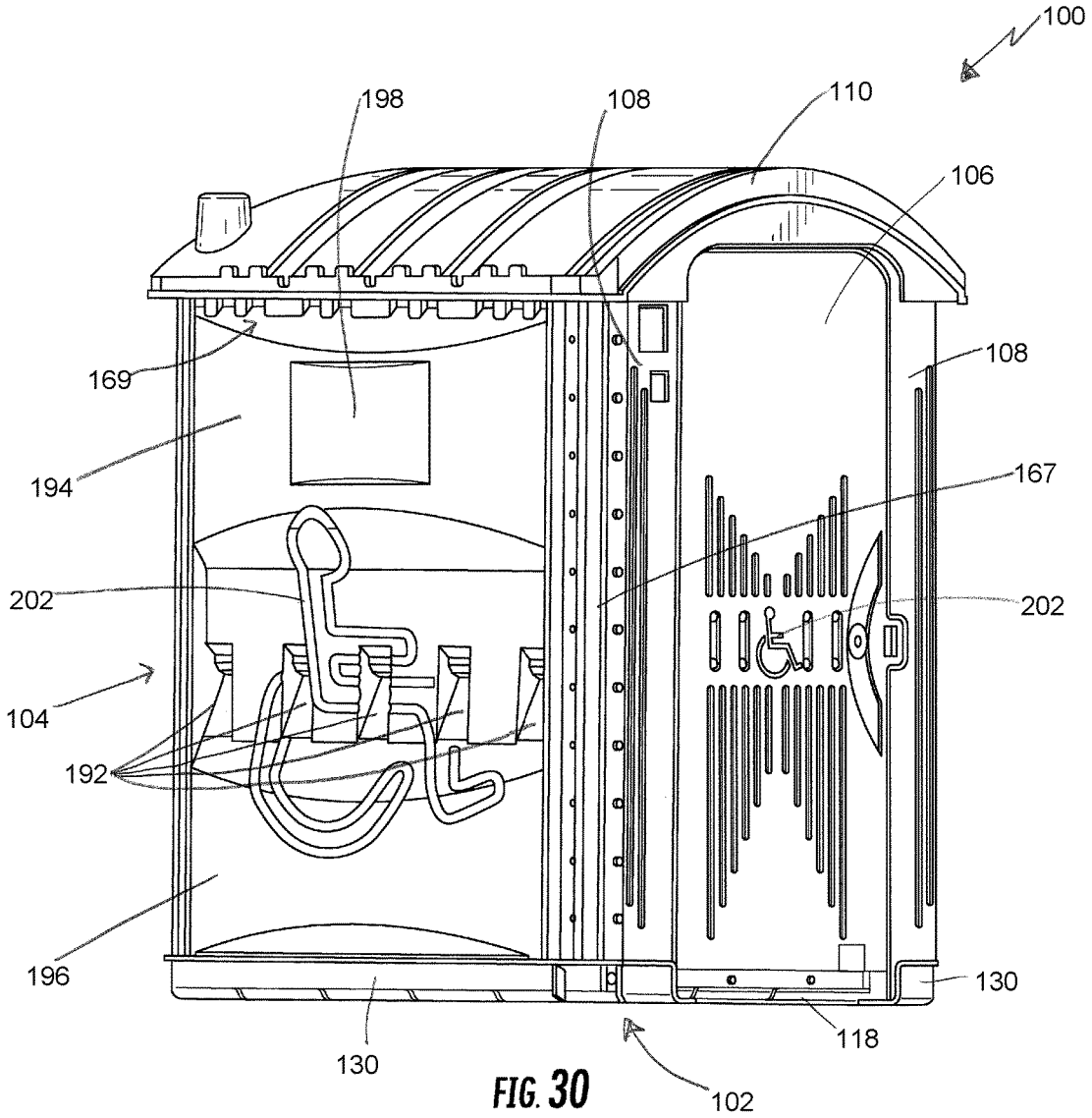
FIG. 30 illustrates a perspective view of a portable restroom according to one or more examples of embodiments.
Figure 33C:
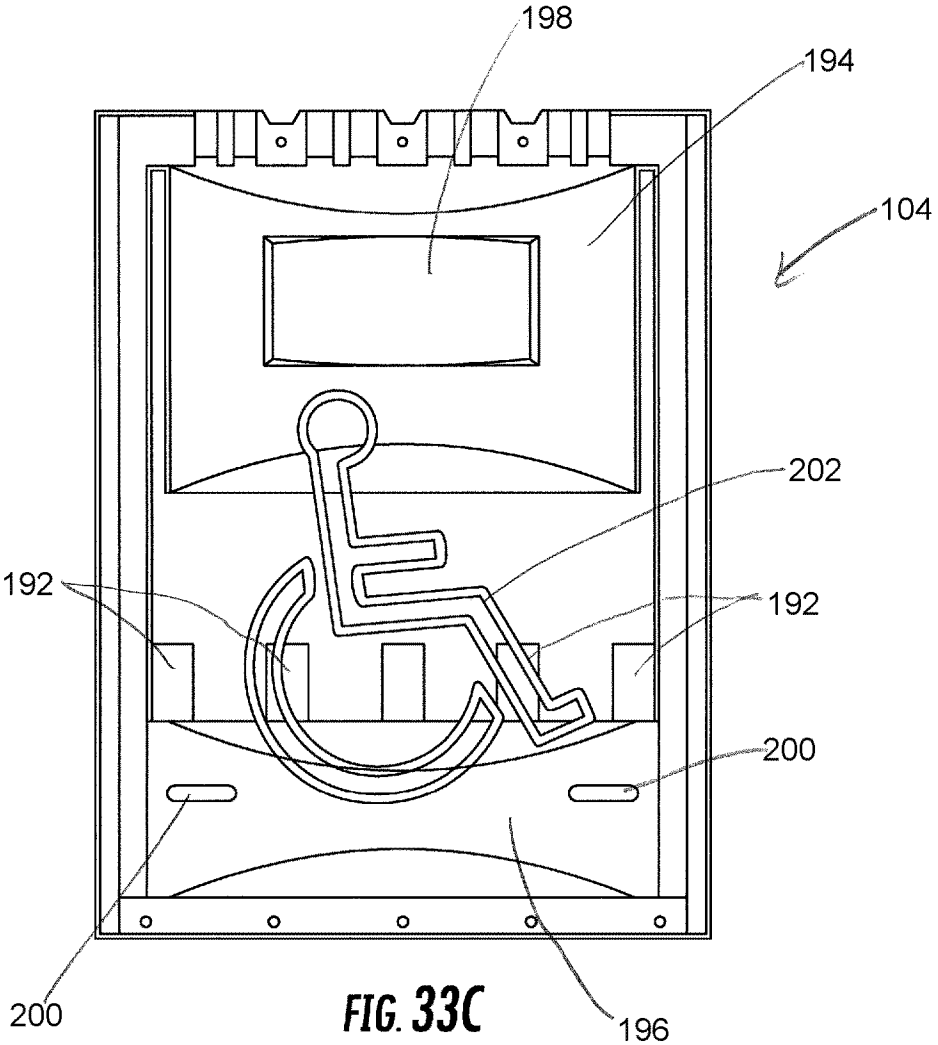
FIG. 33C illustrates a front elevation view of a wall panel for use with the portable restroom described herein.
Figure 33A:
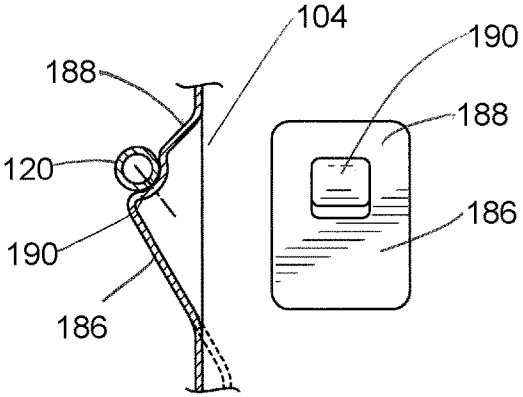
FIG. 33A illustrates an alternative view of a grab bar support or mount.
Figure 33B:
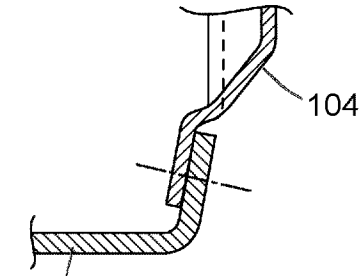
FIG. 33B illustrates an alternative floor to sidewall connection for the portable restroom shown in FIG. 30.

Referring to FIGS. 30, 31, 33C on the exterior side of a sidewall 104 having one or more grab bar mounts 178, the wall may have one or more recesses 192 corresponding to the grab bar mounts 178. In addition to the foregoing, the sidewalls 104 or wall panels the portable restroom 100 disclosed herein and shown in FIGS. 30, 33C include one or more wall segments 194, 196 which are outwardly curved, and advantageously may provide added stiffness to the sidewall or wall panel. In the illustrated examples shown in FIGS. 30, 33C, two outwardly curved wall segments 194, 196 in a sidewall 104 or wall panel are provided, including for example a curve ranging from less than one inch to greater than two inches from the plane; and in one particular example, may be a one to two inch outwardly curved upper segment 194 and a one to two inch outwardly curved lower segment 196. To accommodate a curved lower segment, in one example, a floor to sidewall connection such as shown in FIG. 33B may be used. However, the previously discussed floor to sidewall connections may also be used. The upper segment 194 may include label area 198, or in one example a curved label area, which may have a lesser dimension, such as for example, a one inch in depth of the curve. The lower segment 196 may include one or more lift handles 200, or the handles may be proximate thereto. One or more lift handles or hand holds may also be provided in or proximate the upper segment 194 (not shown). In addition, in one or more examples of embodiments, the wall panel or sidewall 104 may optionally include a symbol 202, such as a handicap symbol, raised or recessed in a portion of the wall panel. The symbol 202 may be spaced to avoid certain interior features, such as but not limited to, the paper holder, the grab bar, the urinal, and the changing table mounting locations.

Accordingly, an improved portable restroom is provided which may be an accessible or ADA/ANSI compliant style of portable restroom. The portable restroom offers features providing users with temporary toilet functions in a physically and emotionally secure environment while offering the owner/operator a cost-effective and durable means of providing service. The portable restroom accomplishing the foregoing objectives includes one or more of the features of: structural supports and/or curved sidewall segments allowing for the use of lighter weight material or construction of thinner walls and roof; improved holding tank structure; improved joints; vertical and horizontal grab bars; grab bar mounts which are molded into the restroom sidewall and facilitate mounting high impact yet flexible tubing; an improved floor structure formed of an at least partially hollow core, a single sheet floor, and a floor having upturned flanges which provide an area for attachment of the sidewalls; and integrated recesses in the floor for lift truck forks, among other features.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. A portable restroom having a floor structure, the floor structure comprising:

a sheet of material forming a floor;

the material having an upturned flange surrounding its perimeter;

a threshold formed by a recess in the upturned flange on the perimeter of the material sheet; and one or more self-leveling devices for leveling the floor, wherein the one or more self-leveling devices comprises a slit adjacent to the threshold.

2. The portable restroom of claim 1, wherein the one or more self-leveling devices comprises a first slit on a first side of the threshold and a second slit on a second side of the threshold.

3. The portable restroom of claim 2, wherein the first slit further comprises a through hole and the second slit further comprises a through hole.

4. The portable restroom of claim 1, wherein the one or more self-leveling devices further comprises a through hole.

5. The portable restroom of claim 1, wherein the one or more self-leveling devices level the threshold.

6. A portable restroom having a floor structure, the floor structure comprising:

a sheet of material forming a floor;

the material having an upturned flange surrounding its perimeter;

a threshold formed by a recess in the upturned flange on the perimeter of the material sheet; and one or more devices for leveling the floor, wherein the one or more devices comprises a jamb leveler which is a jack screw coupled to a pad.

7. The portable restroom of claim 6, wherein the pad comprises a drain bole.

8. The portable restroom of claim 6, further comprising a jack nut on the jack screw.

9. The portable restroom of claim 6, wherein at least one of the jack screw or pad is in a pocket in the floor.

10. The portable restroom of claim 6, wherein the one or more self-leveling devices level the threshold.

11. The portable restroom of claim 6, wherein a plurality of jack screws coupled to pads are provided in the floor.

12. A floor structure for a portable restroom comprising:

a sheet of material forming a floor;

the material having an upturned flange surrounding its perimeter;

a threshold formed by a recess in the upturned flange on the perimeter of the material sheet; and self-leveling devices for leveling the threshold, wherein the self-leveling devices comprise a first slit and through hole on a first side of the threshold and a second slit and through hole on a second side of the threshold, which slits isolate the threshold from compressive stresses and allow the threshold to self-level and lie flat.

13. The floor structure of claim 12, wherein the one or more self-leveling devices level the floor.

14. A floor structure for a portable restroom structure comprising:

a sheet of material forming a floor;

the material having an upturned flange surrounding its perimeter;

a threshold formed by a recess in the upturned flange on the perimeter of the material sheet; and a device for leveling the floor, wherein the device comprises a jamb leveler provided in the floor, wherein the jamb leveler is a jack screw coupled to a pad.

15. The floor structure of claim 14, wherein the jamb leveler comprises a drain hole.

16. The floor structure of claim 14, further comprising a jack nut on the jack screw.

17. The floor structure of claim 14, wherein at least one of the jack screw or pad is in a pocket in the floor.

18. The floor structure of claim 14, wherein a plurality of jack screws coupled to pads are provided in the floor.

19. The floor structure of claim 14, wherein the one or more self-leveling devices level the floor.

* * * * *